US008576028B2

(12) United States Patent
Iwata

(10) Patent No.: US 8,576,028 B2
(45) Date of Patent: Nov. 5, 2013

(54) SWITCH DEVICE, SWITCH DEVICE SYSTEM, AND SWITCH APPARATUS INCLUDING SWITCH DEVICE OR SWITCH DEVICE SYSTEM

(75) Inventor: Atsuki Iwata, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 153 days.

(21) Appl. No.: 13/013,454

(22) Filed: Jan. 25, 2011

(65) Prior Publication Data

US 2011/0181380 A1 Jul. 28, 2011

(30) Foreign Application Priority Data

Jan. 25, 2010 (JP) ..... 2010-013592
Dec. 15, 2010 (JP) ..... 2010-279907

(51) Int. Cl.
*H01H 43/02* (2006.01)
*H01H 7/00* (2006.01)

(52) U.S. Cl.
USPC ..... 335/63; 335/60

(58) Field of Classification Search
USPC ..... 335/2, 59–65, 68, 71, 72
See application file for complete search history.

(56) References Cited

U.S. PATENT DOCUMENTS 3,723,923 A * 3/1973 Suzuki ..... 335/81
4,378,541 A * 3/1983 Kanada et al. ..... 335/61
2006/0145794 A1* 7/2006 Batteux ..... 335/128

FOREIGN PATENT DOCUMENTS

JP 2002-8490 1/2002
JP 2002-159143 5/2002

* cited by examiner

*Primary Examiner* — Bernard Rojas
(74) *Attorney, Agent, or Firm* — Oblon, Spivak, McClelland, Maier & Neustadt, L.L.P.

(57) ABSTRACT

A switch device includes: a switch manipulation portion that is manipulated between an ON position and an OFF position; a detecting unit that detects which position the switch manipulation portion is positioned at, the ON position or the OFF position; a first mechanism that, when the switch manipulation portion is manipulated from the OFF position to the ON position, causes a first electrical contact point to enter an ON state; and a second mechanism that, when the switch manipulation portion is manipulated to the OFF position, causes the switch manipulation portion to enter an OFF state and to maintain the ON state of the first electrical contact point, and changes the state of the first electrical contact point to the OFF state by making an electrical signal be in an OFF state, an ON state, and an OFF state in this order.

12 Claims, 24 Drawing Sheets

- WHEN IT IS DETECTED THAT SIGNAL SWITCH (4) IS TURNED ON, RELAY IS IMMEDIATELY TURNED ON.
- WHEN IT IS DETECTED THAT SIGNAL SWITCH (4) IS TURNED OFF, RELAY IS TURNED ON AFTER 1 SECOND.

SWITCH DEVICE, SWITCH DEVICE SYSTEM, AND SWITCH APPARATUS INCLUDING SWITCH DEVICE OR SWITCH DEVICE SYSTEM

CROSS-REFERENCE TO RELATED APPLICATIONS

The present application claims priority to and incorporates by reference the entire contents of Japanese Patent Application No. 2010-013592 filed in Japan on Jan. 25, 2010 and Japanese Patent Application No. 2010-279907 filed in Japan on Dec. 15, 2010.

BACKGROUND OF THE INVENTION

1. Field of the Invention

The present invention relates to a switch device that connects/breaks the flow of an electrical signal or connects/breaks the flow of power, a switch device system that includes the switch device, and a switch apparatus that includes the switch device or the switch device system. More particularly, the present invention relates to a switch device in which switch contact points are simultaneously closed to enter an ON state at the time of an ON manipulation thereof but the switch contact points are not simultaneously opened to enter an OFF state at the time of an OFF manipulation thereof and which can recognize the ON/OFF manipulation state of the switch and can transmit information to a unit provided outside the switch; a switch device system that includes the switch device; and a switch apparatus that includes the switch device or the switch device system. Further, the OFF manipulation of the switch contact points is performed in a manner such that the switch contact points are opened to enter an OFF state after a signal is received from a unit that is disposed outside the switch and recognizes the ON/OFF manipulation state of the switch, in which the signal is a signal representing the status that the unit is completely prepared for the turning off of the contact points. Furthermore, the present invention relates to a switch device that can simultaneously change the state of a switch and the states of switch contact points to an OFF state in response to a signal sent from a unit provided outside the switch when the state of the switch and the states of the switch contact points are an ON state, relates to a switch device system that includes the switch device, and relates to a switch apparatus that includes the switch device or the switch device system.

2. Description of the Related Art

As the related art technique of connecting/breaking the flow of AC power, there are, for example, the following techniques. In a first related art, an AC contact point is opened and closed by the ON/OFF manipulation of a power switch, so that AC power is supplied and interrupted. In a second related art, for example, a projector apparatus or the like is not provided with a main switch. The projector apparatus is started by a push-button switch and prepares for the turning-off thereof by a push-button switch after use. After the projector apparatus is completely ready to be turned off, an AC plug is pulled out from an outlet.

In general, the first and second related arts are the mainstream. However, for example, in the first related art, there is a problem in that the apparatus breaks if the supply of AC power is stopped at a timing where the apparatus is not ready to be turned off, such as during the operation of a hard disk drive (HDD), during the cooling of a direct current (DC) power source, during the cooling of a heating unit, or the like when the power switch is suddenly manipulated from an ON position to an OFF position.

Further, as in the first related art, according to the second related art, the apparatus may be able to reliably prepare for the turning off. However, as long as the AC plug is being put into the outlet, the power is consumed to detect the manipulation of the push-button switch and thus AC power is always consumed to cause the apparatus to be ready to be turned on. For this reason, there are problems in that the energy saving is not effectively achieved and a user feels difficulty in using the apparatus.

In order to solve the problems, in a third related art, the operation of an extractor fan switch of a bathroom is employed in connecting/breaking the flow of AC power, and the ON/OFF manipulation state of the switch is detected by another switch or a detection unit. If it is detected that the switch is in an OFF state, processing of causing an apparatus to prepare for the turning-off is promptly performed. As a result, the apparatus comes to be ready for the interruption of AC power that is performed by a timer of a spiral spring unit of the extractor fan switch.

The third related art is excellent in that a processing of causing an apparatus to prepare for the turning off can be surely performed when the turning-off is attributable to the interruption of AC power or in that unnecessary power is not consumed. However, it has a problem that the mechanical structure is complicated somewhat, and thus high cost is incurred in manufacturing. In addition, even if the apparatus finishes the preparation for the turning-off in a short time, it still takes a predetermined time until the AC power is interrupted. For this reason, slight unnecessary power consumption may occur.

In order to solve these problems, in a fourth related art, there is provided a system where a relay contact point and an AC contact point of a power switch are provided in parallel with each other, and a switch and a relay are combined with each other to serve as a switch unit. In such a manner, an electronic timer unit is established. According to the fourth related art, it may be possible to solve the problems of the third related art. However, there are other problems in that the size of the switch unit is larger several times than that of the existing power switches; the number of AC contact circuits needs to be increased two times; unnecessary power for the operation of the timer is always consumed; and excitation current for a relay always flows while the power switch is turned on. Further, even when the preparation of the apparatus for turning-off has been finished within a short time, a predetermined time is required for AC power to be interrupted. For this reason, there still remains an unsolved problem such as consumption of slight unnecessary power.

Accordingly, a fifth related art employs a system in which a switch portion and a relay portion of the fourth related art are separated from each other; the switch portion is further provided with another switch or a detection unit capable of detecting the ON/OFF manipulation state of the switch; a timer is not mounted; and the excitation power is controlled to be cut off after the OFF state is detected and processing of causing an apparatus to prepare for the turning off is then completed.

In the fifth related art, the processing of causing the apparatus to prepare for the turning off is reliably performed and completed when the OFF manipulation state of the switch is detected. Accordingly, the fifth related art is excellent in that it may be possible to reliably interrupt the AC power immediately after the completion of the processing of causing the apparatus to prepare for the turning off. However, the fifth related art is still problematic in that the number of AC contact circuits needs to be increased two times and unnecessary power is always consumed because the excitation current for a relay always flows while the power switch is turned on. There is further problem in that necessary space increases due to mounting of another switch or a detection unit.

The invention has been made in view of the above problems, and an object of the invention is to provide a switch device and a switch device system that (1) can allow an apparatus to safely stop even though a power switch is suddenly turned off, (2) can interrupt AC power by the power switch when an apparatus is not used, (3) incurs less unnecessary power consumption during the operation of the apparatus, (4) incurs less unnecessary power consumption in an OFF mode of an apparatus, (5) can reduce space, which is required for the switch or necessary parts, as much as possible, and (6) can be manufactured at lower cost. The invention further provides a switch apparatus that includes the switch device or the switch device system.

Further, the invention provides a switch that can change the manipulation state of the switch and the state of a switch contact point to an OFF state by a signal sent from a unit provided outside the switch when the manipulation state of the switch and the state of the switch contact point are an ON state, like switches with a reset function as in the related art (for example, AJ8R series manufactured by Panasonic Electric Works Co., Ltd., RS3 series manufactured by Hirose Electric Co., Ltd., A8G series manufactured by Omron Corporation, and the like).

The related arts include Japanese Patent Application Laid-open No. 2002-8490 and Japanese Patent Application Laid-open No. 2002-159143.

SUMMARY OF THE INVENTION

It is an object of the present invention to at least partially solve the problems in the conventional technology.

According to an aspect of the present invention, there is provided a switch device including: a switch manipulation portion that is manipulated between an ON position and an OFF position; a detecting unit that detects which position the switch manipulation portion is positioned at, the ON position or the OFF position; a first mechanism that, when the switch manipulation portion is manipulated from the OFF position to the ON position, causes a first electrical contact point including one or more circuits to enter an ON state; and a second mechanism that, when the switch manipulation portion is manipulated from the ON position to the OFF position, causes the switch manipulation portion to enter an OFF state and to maintain the ON state of the first electrical contact point including one or more circuits, and changes the state of the first electrical contact point to the OFF state from the ON state by making an electrical signal be in an OFF state, an ON state, and an OFF state in this order.

According to another aspect of the present invention, there is provided a switch device including: a switch manipulation portion that is manipulated between an ON position and an OFF position; a detecting unit that detects which position the switch manipulation portion is positioned at, the ON position or the OFF position; a first mechanism that, when the switch manipulation portion is manipulated from the OFF position to the ON position, causes a first electrical contact point including one or more circuits to enter an ON state; a second mechanism that, when the switch manipulation portion is manipulated from the ON position to the OFF position, causes the switch manipulation portion to enter an OFF state, and to maintain the ON state of the first electrical contact point including one or more circuits, and changes the state of the first electrical contact point to the OFF state from the ON state by making an electrical signal, which is input to the switch device, be in an OFF state, an ON state, and an OFF state in this order; and a third mechanism that, when the switch manipulation portion is positioned at the ON position and the first electrical contact is in the ON state, changes the position of the switch manipulation portion from the ON position to the OFF position and changes the state of the first electrical contact point from the ON state to the OFF state by the electrical signal, which is input to the switch device, that is in an OFF state, an ON state, and an OFF state in this order.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Switch devices according to embodiments of the invention and an apparatus including the switch device will be described in detail below with reference to the accompanying drawings. Needless to say, the following embodiments are to illustrate examples of the invention, and it is apparent that those skilled in the art can change, alter, and modify the following embodiments in various ways without departing from the scope of the invention. Accordingly, the invention is not limited to the following embodiments.

First Embodiment

Figure 1:
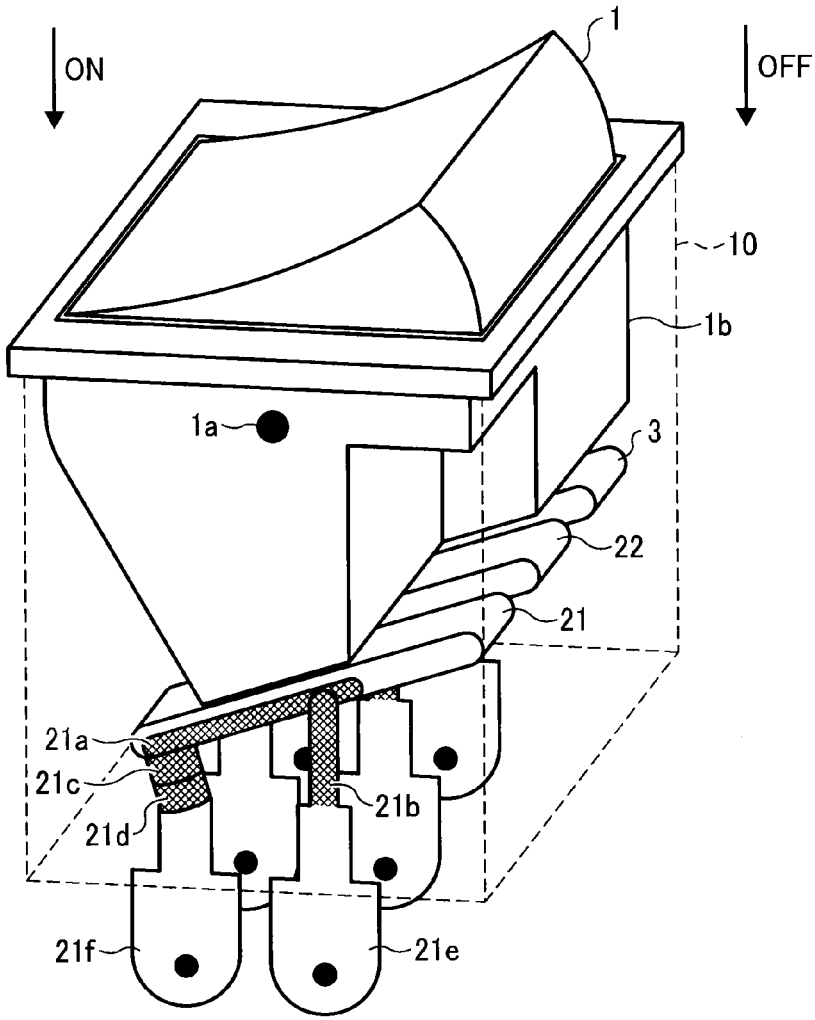
FIG. 1 is a schematic view showing the mechanical structure of a switch body of a switch device according to a first embodiment.

FIG. 1 is a schematic view showing the mechanical structure of a switch body 10 of a switch device according to a first embodiment. FIG. 1 shows a state where a switch manipulation portion 1 is in an ON position.

As shown in FIG. 1, the switch body 10 of this embodiment mainly includes a switch manipulation portion 1, first switch contact levers 21 and 22, and a second switch contact lever 3. Further, the switch body 10 of this embodiment has a first electrical contact point. The first electrical contact point includes a first switch contact lever-side contact point 21*c* and a first switch terminal-side contact point 21*d* that correspond to the first switch contact lever 21 and a first switch contact lever-side contact point (not shown) and a first switch terminal-side contact point (not shown) that correspond to the first switch contact lever 22. These contact points are disposed below a lower portion 1*b* of the switch manipulation portion 1.

Furthermore, the switch body 10 of this embodiment has a second electrical contact point. The second electrical contact point includes a second switch contact lever-side contact point (not shown) and a second switch terminal-side contact point (not shown) that correspond to the second switch contact lever 3. These contact points are disposed below the lower portion 1*b* of the switch manipulation portion 1.

In the switch device according to the first embodiment, the first electrical contact point is always in a closed state (a contact point ON state) when the switch manipulation portion 1 is in an ON position, and the state of the first electrical contact point is not changed to an open state (a contact point OFF state) from a closed state when the switch manipulation portion 1 is manipulated to an OFF position. Further, the second electrical contact point is always in a closed state (a contact point ON state) when the switch manipulation portion 1 is in an ON state, and the second electrical contact is always in an open state (a contact point OFF state) when the switch manipulation portion 1 is in an OFF state. Here, the second electrical contact point exhibits the same behaviors as the electrical contact point of a general switch device (a mechanism where a closed state (a contact point ON state) or an open state (a contact point OFF state) of an electrical contact point is switched in synchronization with the ON/OFF manipulation of the switch manipulation portion).

The switch manipulation portion 1 is formed integrally with the lower portion 1*b* of the switch. Accordingly, when a user presses the switch manipulation portion 1 down, the switch manipulation portion 1 pivots on a fulcrum 1*a* serving as a central axis, so that an ON/OFF operation is performed.

A portion of the lower portion 1*b* of the switch manipulation portion 1, which is opposite to the first switch contact lever-side contact point 21*c* and faces the first switch contact levers 21 and 22, is cut out as shown in FIG. 1. For this reason, the lower surface of the lower portion 1*b* of the switch manipulation portion 1 cannot come into contact with the upper surfaces of the first switch contact levers 21 and 22. Meanwhile, a portion of the lower portion 1*b* of the switch manipulation portion 1, which is opposite to the second switch contact lever-side contact point and faces the second switch contact lever 3, does not have a cut-out portion as shown in FIG. 1. For this reason, the lower surface of the lower portion 1*b* of the switch manipulation portion 1 can come into contact with the upper surface of the second switch contact lever 3. Accordingly, as described below, when the switch manipulation portion 1 is pushed down so as to be manipulated to an OFF position, the lower surface of the lower portion 1*b* of the switch manipulation portion 1 pushes only the second switch contact lever 3 down but does not push the first switch contact levers 21 and 22 down.

When the switch manipulation portion 1 is in an ON position, the entire lower portion 1*b* of the switch manipulation portion 1 comes into contact with the first switch contact levers 21 and 22 and the second switch contact lever 3. Accordingly, in this ON state, a contact state is maintained between the first switch contact lever-side contact point 21*c* and the first switch terminal-side contact point 21*d* that correspond to the first switch contact lever 21; a contact state is maintained between the first switch contact lever-side contact point (not shown) and the first switch terminal-side contact point (not shown) that correspond to the first switch contact lever 22; and a contact state is maintained between the second switch contact lever-side contact point (not shown) and the second switch terminal-side contact point (not shown) that correspond to the second switch contact lever 3. Therefore, the state of three electrical contact points of the three contact levers, that is, the first switch contact levers 21 and 22 and the second switch contact lever 3, respectively, become a closed state (a contact point ON state), so that circuit current flows.

A switch contact circuit corresponding to the first switch contact lever 21 will be specifically described. The electrical connection is made each other among a terminal 21*e* that is normally in a contact state during the operation of the first switch contact lever (hereinafter, simply referred to as a normally-contacting conductor-side terminal 21*e*), the conductor 21*b* that is normally in a contact state during the operation of the first switch contact lever (hereinafter, simply referred to as a normally-contacting conductor 21*b*), a first switch contact lever conductor 21*a*, the first switch contact lever-side contact point 21*c*, the first switch terminal-side contact point 21*d*, and a first switch ON-OFF contact point-side terminal 21*f*. Accordingly, circuit current flows. Two switch contact circuits, which correspond to the first switch contact lever 22 and the second switch contact lever 3, are the same as described above (not shown).

Meanwhile, in an event in which the switch manipulation portion 1 is pushed down so that it is manipulated to an OFF position from an ON position, since the lower portion 1*b* of the switch manipulation portion 1 is in contact with the entire surface of the second switch contact lever 3 that is positioned at the inner side of the switch device, when the switch manipulation portion 1 is manipulated from an ON position to an OFF position, the second switch contact lever 3 pivots and thereby causes cancellation of the contact state between the second switch contact lever-side contact point (not shown) and the second switch terminal-side contact point (not shown), which correspond to the second switch contact lever 3. As a result, the second electrical contact point enters an open state (a contact point OFF state).

Further, since a portion of the lower portion 1*b* of the switch manipulation portion 1, which corresponds to the first switch contact levers 21 and 22, has a cut-out portion, even when the switch manipulation portion 1 is pushed down so as to be manipulated to an OFF position, the lower portion 1*b* of the switch manipulation portion 1 does not come into contact with the first switch contact levers 21 and 22 and thus the first switch contact levers 21 and 22 are not pushed down. For this reason, in this state, a contact state, that is, a closed state (a contact point ON state) is maintained between the first switch contact lever-side contact point 21*c* and the first switch terminal-side contact point 21*d* that correspond to the first switch contact lever 21 and between the first switch contact lever-side contact point (not shown) and the first switch terminal-side contact point (not shown) that correspond to the first switch contact lever 22.

According to this switch mechanism, if the contact state between the second switch contact lever-side contact point (not shown) and the second switch terminal-side contact point (not shown), which correspond to the second switch contact lever 3, is detected inside or outside of the switch, it may be possible to detect which of an ON position and an OFF position the switch manipulation portion 1 is manipulated to.

Figure 25:
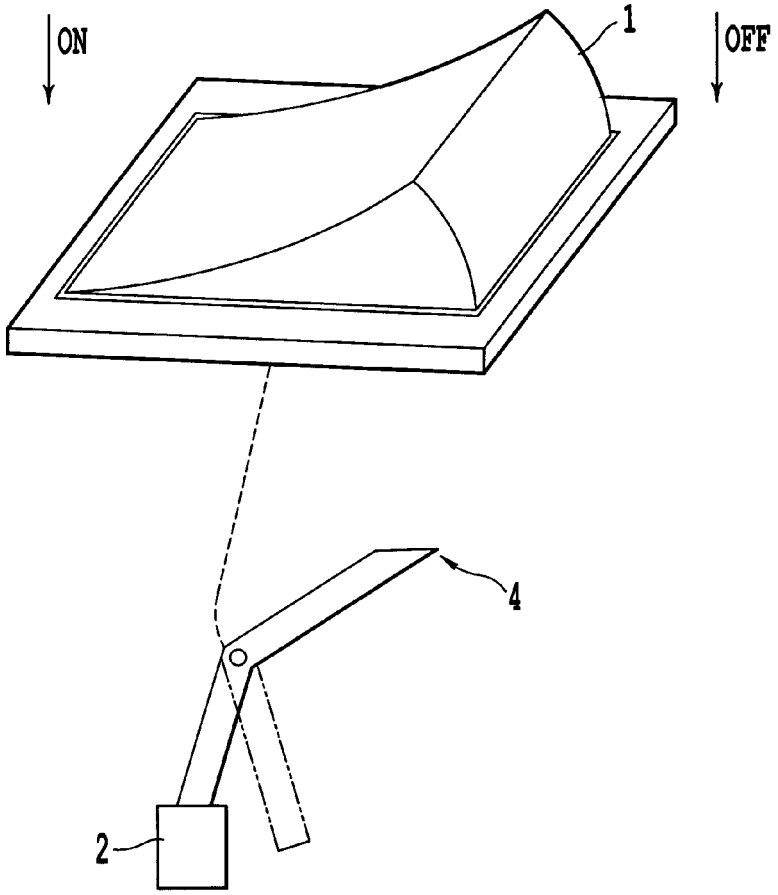
FIG. 25 is a schematic view showing the structure of a detection mechanism employing a light shielding plate and a photointerrupter.

Moreover, in this embodiment, the detection of the contact state between the second switch contact lever-side contact point (not shown) and the second switch terminal-side contact point (not shown) has been used as a means for detecting which of an ON position and an OFF position the switch manipulation portion 1 is manipulated to. However, the means for detecting is not limited thereto. For example, as shown in FIG. 25, the means may be constructed by employing a light shielding plate 4, which changes the light receiving state of a photointerrupter 2 that is interlocked with the switch manipulation portion 1 in terms of operation.

Further, the second electrical contact point, which includes the second switch contact lever-side contact point and the second switch terminal-side contact point, may be adapted to be opened (OFF) and closed (ON) in synchronization with the ON/OFF manipulation of the switch manipulation portion 1. The first electrical contact point, which includes the first switch contact lever-side contact point 21*c* and the first switch terminal-side contact point 21*d*, may be adapted to be maintained in a closed state instead of being synchronized with the manipulation of the switch manipulation portion 1 to an OFF position from an ON position.

There is described next a mechanism of changing the state of the first electrical contact point to an open state (a contact point OFF state) from a closed state (a contact point ON state) when the switch manipulation portion 1 is manipulated to an OFF position from an ON position.

Figure 2:
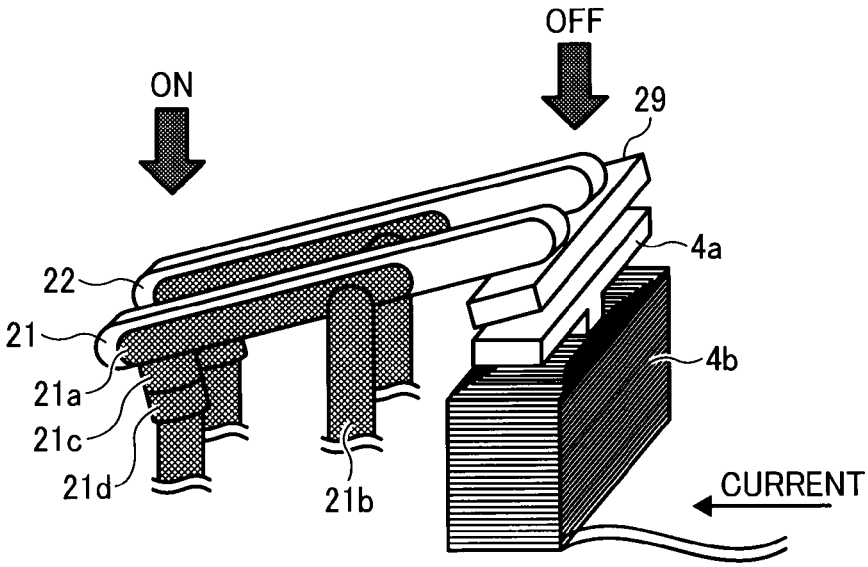
FIG. 2 is a schematic view showing the structure of a mechanism, which changes the state of a first electrical contact point to an open state (a contact point OFF state) from a closed state (a contact point ON state), in the switch device according to the first embodiment.

FIG. 2 is a schematic view showing the structure of a mechanism, which changes the state of the first electrical contact point to an open state (a contact point OFF state) from a closed state (a contact point ON state), in the switch device according to the first embodiment. FIG. 2 shows only portions that are positioned below the first switch contact levers 21 and 22. Further, FIG. 2 shows a state where current does not flow through an electromagnet coil 4*b*, which operates to change the position of the switch contact lever to an OFF position from an ON position, (hereinafter, simply referred to as a switch contact point lever ON-to-OFF operation electromagnet coil 4*b*) when the switch manipulation portion 1 is manipulated to an OFF position.

When the switch manipulation portion 1 is manipulated from an ON position to an OFF position, the second electrical contact point (the second switch contact lever-side contact point and the second switch terminal-side contact point) enters an open state as described above. However, the first electrical contact point (the first switch contact lever-side contact point 21*c* and the first switch terminal-side contact point 21*d*, and the first switch contact lever-side contact point (not shown) and the first switch terminal-side contact point (not shown) corresponding to the first switch contact lever 22) maintains a contact state and thus the first electrical contact point enters a closed state (a contact point ON state).

As shown in FIG. 2, in the switch body 10 shown in FIG. 1, an iron plate (magnetic body) 29 for an ON-to-OFF operation of the switch contact levers (hereinafter, simply referred to as a switch contact point lever ON-to-OFF operation iron plate 29) is joined to the lower portions of the first switch contact levers 21 and 22. Accordingly, the first switch contact levers 21 and 22 are interlocked in terms of operation.

Further, as shown in FIG. 2, in the switch body 10 shown in FIG. 1, an iron core 4*a* for an ON-to-OFF operation of the switch contact levers (hereinafter, simply referred to as a switch contact point lever ON-to-OFF operation iron core 4*a*) is disposed so as to face the switch contact point lever ON-to-OFF operation iron plate (magnetic body) 29 while the switch contact point lever ON-to-OFF operation electromagnet coil 4*b* is wound around the switch contact point lever ON-to-OFF operation iron core 4*a*. Here, the switch contact point lever ON-to-OFF operation iron core 4*a* and the switch contact point lever ON-to-OFF operation electromagnet coil 4*b* form an electromagnet. When current is made to flow in the switch contact point lever ON-to-OFF operation electromagnet coil 4*b* by a circuit structure to be described below, the switch contact point lever ON-to-OFF operation iron core 4*a* is magnetized. Accordingly, when current flows in the switch contact point lever ON-to-OFF operation electromagnet coil 4*b*, an electromagnetic attracting force acts between the switch contact point lever ON-to-OFF operation iron core 4*a* and the switch contact point lever ON-to-OFF operation iron plate (magnetic body) 29 and pulls down the right-side portions of the first switch contact levers 21 and 22 in FIG. 2. Therefore, the contact state of the first electrical contact point (that is, the first switch contact lever-side contact point 21*c* and the first switch terminal-side contact point 21*d*, and the first switch contact lever-side contact point (not shown) and the first switch terminal-side contact point (not shown) corresponding to the first switch contact lever 22) is canceled and thus the first electrical contact point enters an open state (a contact point OFF state). Here, current, which flows in the switch contact point lever ON-to-OFF operation electromagnet coil 4*b*, may be any one of direct current and alternate current.

The above description relates to the case where the switch manipulation portion 1 is manipulated to an OFF position. Meanwhile, regarding the case where the switch manipulation portion 1 is manipulated to an ON position, when current flows in the switch contact point lever ON-to-OFF operation electromagnet coil 4*b*, the contact state of the first electrical contact point is canceled and at the same time the position of the switch manipulation portion 1 may be changed to an OFF position from an ON position by a force that pulls up the left-side portions of the first switch contact levers 21 and 22 in FIG. 2.

Meanwhile, in the structure of the above-mentioned switch, the first switch contact lever conductor 21*a* and the normally-contacting conductor 21*b* always are in contact with each other at any case where the first switch contact lever 21 is operated to be positioned at an ON position or an OFF position. The first switch contact lever 22 and the second switch contact lever 3 are the same as described above.

According to the structure of the switch, since the first switch contact point provided inside the switch is left in an ON state even though the switch manipulation portion 1 is manipulated from an ON position to an OFF position at any time, the first electrical contact point is not suddenly turned off. Therefore, after the OFF state of the switch is detected, it may be possible to enable a machine to safely stop or to allow completion of an ongoing operation that is being performed. Further, since a relay contact point does not need to be maintained in an ON state by excitation current unlike in the related art, unnecessary power consumption does not occur. For this reason, energy for maintaining a first switch contact circuit is not needed even while a machine is operating or is in an OFF mode because, in the contact point ON state, the contact state of the first electrical contact point is maintained and completed by the OFF-to-ON manipulation of the switch manipulation portion 1.

When the manipulation of the switch manipulation portion 1 to an OFF position from an ON position is detected by the second electrical contact point, it may be possible to make the state of the first electrical contact point become an OFF state by an electromagnet (bimetal or the like in a second embodiment to be described below) after shutdown pre-processing is performed. The shutdown pre-processing is a processing for safely stopping various apparatuses before interruption of the supply of AC input voltages to the various apparatuses. Accordingly, since the first electrical contact point is made to enter an OFF state when an apparatus is not used, it may be possible to reduce unnecessary power consumption and to cut off a power source.

Further, a relay circuit disposed in parallel with the switch is not necessary, unlike the related art. The first electrical contact point itself functions both as a switch and a relay that is disposed in the related art at the same time. Accordingly, it may be possible to obtain a switch device that is advantageous in terms of cost and scale reduction and an apparatus including the switch device.

Figure 3:
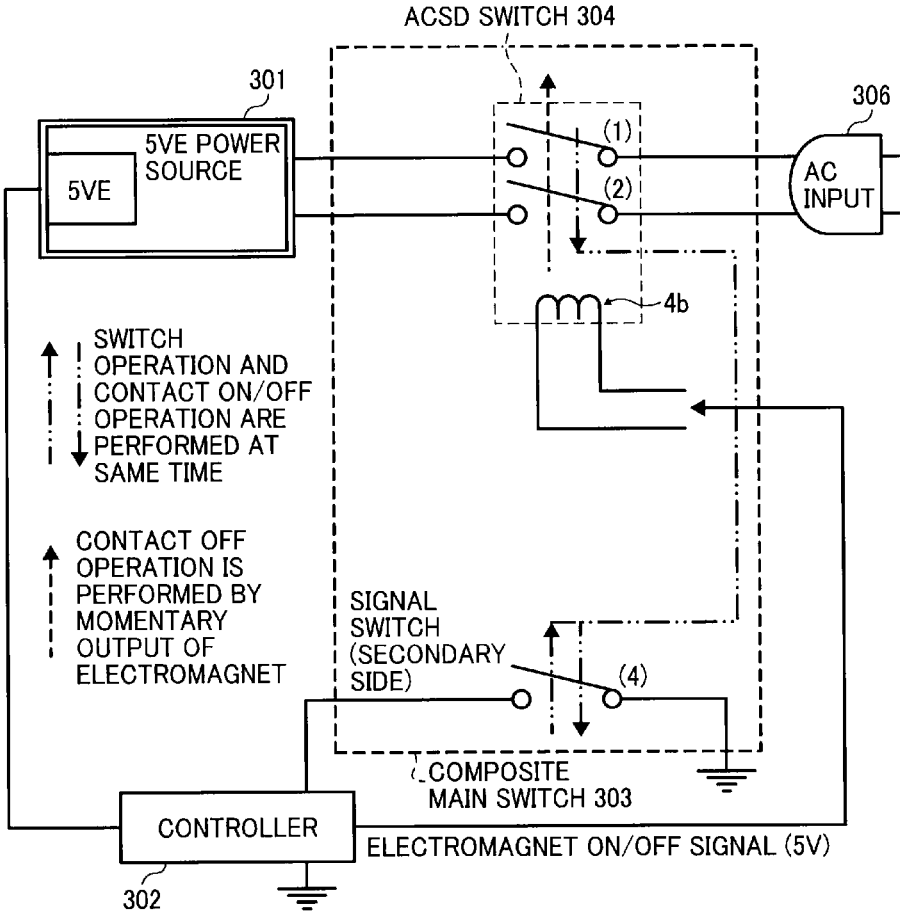
FIG. 3 is a circuit diagram illustrating the flow of a signal and the operation of a contact point of a switch of the first embodiment.

Next, there will be described a circuit structure that causes the first electrical contact point to enter an open state by making current flow in the electromagnet. FIG. 3 is a circuit diagram illustrating the flow of a signal and the operation of a contact point of the switch of the first embodiment.

As shown in FIG. 3, a circuit structure of this embodiment mainly includes a 5VE power source 301, a controller 302, and a composite main switch 303.

The 5VE power source 301 is a power source for the control of a DC low-voltage, and is a power source that is required always to supply an output voltage of DC 5V or the like when a control unit is in operation. The composite main switch 303 includes an AC shutdown (ACSD) switch 304, an electromagnet, and a signal switch (4). Only a switch contact point lever ON-to-OFF operation electromagnet coil 4*b* of the electromagnet is shown in FIG. 3.

The signal switch (4) corresponds to the second switch contact lever-side contact point and the second switch terminal-side contact point (which are not shown) serving as the second electrical contact point. Accordingly, as described above, the signal switch (4) enters a closed state (a contact point ON state) by an interlocking operation with an ON manipulation of the switch manipulation portion 1, and enters an open state (a contact point OFF state) by an interlocking operation with an OFF manipulation of the switch manipulation portion 1. The controller 302 can detect which of an ON position and an OFF position the switch manipulation portion 1 is manipulated to, by detecting the ON/OFF state of the signal switch (4). Further, since the controller 302 is a control unit, it is required to be always supplied with an output voltage of DC 5V or the like while it is operating.

The ACSD switch 304 includes switch circuits (1) and (2). Here, the switch circuits (1) and (2) correspond to the first electrical contact point. Specifically, the switch circuit (1) corresponds to the first switch contact lever-side contact point 21*c* and the first switch terminal-side contact point 21*d*. The switch circuit (2) corresponds to the first switch contact lever-side contact point (not shown) and the first switch terminal-side contact point (not shown), which correspond to the first switch contact lever 22 shown in FIG. 1.

When the switch manipulation portion 1 is manipulated to an ON position, the states of the switch circuits (1) and (2) become an ON state, that is, a closed state. Accordingly, AC power is supplied to the 5VE power source 301 (a power source for the control of a DC low-voltage) from a commercial power source AC input 306. Meanwhile, when the switch manipulation portion 1 is manipulated to an OFF position, the states of the contact points of the switch circuits (1) and (2) serving as the first electrical contact point do not immediately become an open state thanks to the above-mentioned mechanism so that the AC power is prevented from sudden interruption.

In FIG. 3, an arrow shown by a two-dot chain line shows an ON/OFF state where the operation of an electrical contact point is interlocked with the manipulation of the switch manipulation portion 1. Accordingly, the switch circuits (1) and (2) enter a closed state (a contact point ON state) by an interlocking operation with only the ON manipulation of the switch manipulation portion 1 in an open state (a contact point OFF state). (The contact states of the switch circuits (1) and (2), which have become a closed state (a contact point ON state) once, are maintained in a closed state (a contact point ON state) when the ON/OFF manipulation of the switch manipulation portion 1 is performed later.) It may be possible to make the states of the switch circuits (1) and (2) become an open state (a contact point OFF state) by making current flow in the switch contact point lever ON-to-OFF operation electromagnet coil 4*b* (to be described below).

An arrow shown by a dotted line of FIG. 3 shows that the state of the switch contact point may be changed to an OFF state from an ON state by a momentary force of the electromagnet. Such switch contact points correspond to the contact points of the switch circuits (1) and (2). That is, when current flows in the switch contact point lever ON-to-OFF operation electromagnet coil 4*b*, the states of the switch circuits (1) and (2) become an open state.

The controller 302 is connected to the 5VE power source 301. The controller 302 detects the open/closed state of the signal switch (4). When the open state of the signal switch (4) is detected, the controller 302 immediately performs shutdown pre-processing. Here, in an image forming apparatus, the shutdown pre-processing corresponds to the stop of reading and writing or the completion of the ongoing processing of a hard disk drive (HDD); the completion of an image forming operation; the rotation of a cooling fan for a predetermined time; the stop of various operating objects at home positions; or the like. Further, in the case of electrical equipment, machine tools, medical equipment, automobiles, transport equipment, or the like, the shutdown pre-processing corresponds to the recording of data; the completion or safe stop of an in-process job; or the like.

When the controller 302 completes the shutdown pre-processing, the controller 302 outputs an electromagnet ON signal to the electromagnet and thus turns on the electromagnet by making current flow in the switch contact point lever ON-to-OFF operation electromagnet coil 4*b* of the electromagnet. Accordingly, the states of the contact points of the switch circuits (1) and (2) serving as the first electrical contact point become an open state and a contact point OFF state.

Here, the electromagnet ON signal is an electrical signal that is to make the state of the first electrical contact point become an open state (a contact point OFF state) by making current flow in the electromagnet in order to turn on the electromagnet. The current itself flowing in the electromagnet may be used as the electromagnet ON signal, and a control signal for changing the state of the current of the electromagnet to an ON state from an OFF state may be used as the electromagnet ON signal (for example, a first modification of the first embodiment shown in FIG. 5 to be described below). However, the electromagnet ON signal is not limited thereto.

Here, just a short time of the ON control of the electromagnet, which is performed by the controller 302, is sufficient, for example, 0.1 second. For this reason, energy, which is consumed in the operation of the ON control of the electromagnet, is very small. Here, it is preferable that the ON control of the electromagnet be performed for a short time by the controller 302. However, if the contact points of the switch circuits (1) and (2) are in an open state even though the ON control of the electromagnet continues to be performed, the supply of power to the 5VE power source 301 from the AC input 306 is stopped in this embodiment. Accordingly, the energy of current, which is made to flow in the electromagnet by the controller 302, is also automatically lost. Even in any one of the structures, the controller 302 can decide the sequence of shutdown (the opening of the contact of an AC switch) by detecting that the switch manipulation portion 1 is manipulated to an OFF position.

Figure 4:
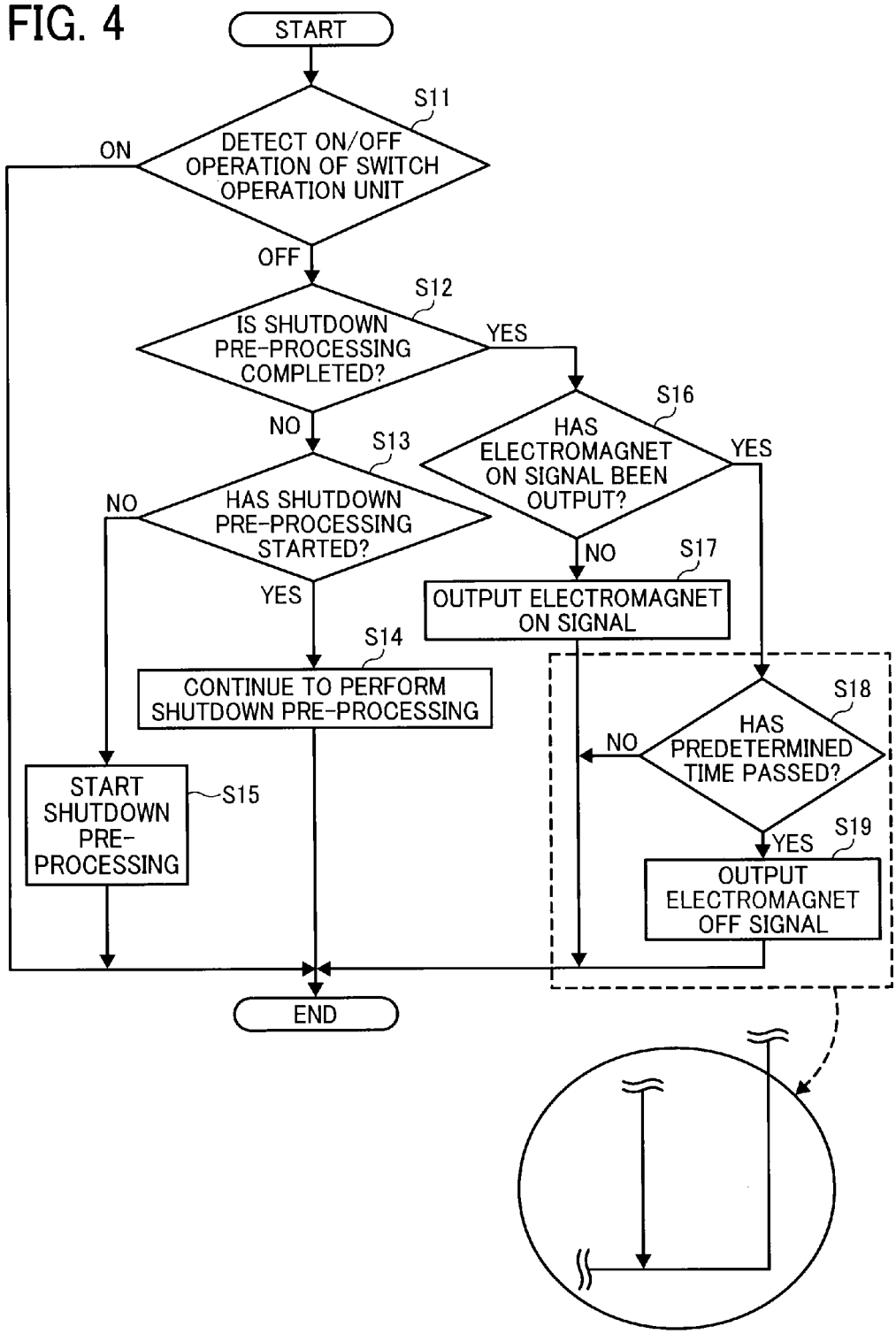
FIG. 4 is a flowchart illustrating a procedure of control processing that is performed by a controller of the first embodiment.

Next, there will be described in detail the control of changing the state of the first electrical contact point to the contact point OFF state (open state) from the contact point ON state (closed state), which is performed by the controller 302 when the switch manipulation portion 1 is manipulated to an OFF position from an ON position. FIG. 4 is a flowchart illustrating a procedure of control processing that is performed by the controller 302 of the first embodiment. Here, the control processing illustrated in FIG. 4 may be adapted to be performed every time during the main routine of the control performed by the controller, and may be adapted to be performed every predetermined time such as 20 ms.

First, the controller 302 detects which position of an ON position and an OFF position the switch manipulation portion 1 is positioned at, by detecting the open/closed state of the second electrical contact point, that is, the signal switch (4) (Step S11). Here, it may be possible to detect whether the signal switch (4) is opened or closed, by pulling up or down an input signal on a voltage other than GND through a resistor on the controller 302. Specifically, the controller 302 detects that the switch manipulation portion 1 is positioned at an ON position if the controller 302 detects that the signal switch (4) is in a closed state. The controller 302 detects that the switch manipulation portion 1 is positioned at an OFF position if the controller 302 detects that the signal switch (4) is in an open state.

Further, if the switch manipulation portion 1 is positioned at an ON position (ON at Step S11) the controller 302 stands by until the next processing. Meanwhile, if the switch manipulation portion 1 is positioned at an OFF position (OFF at Step S11), the controller 302 determines whether shutdown pre-processing is completed or whether shutdown pre-processing is not necessary (Step S12).

Furthermore, if the controller determines that shutdown pre-processing is not completed or is necessary (No at Step S12), the controller 302 further determines whether shutdown pre-processing has started (Step S13). Moreover, if shutdown pre-processing has started (Yes at Step S13), the controller 302 continues to perform shutdown pre-processing (Step S14) and stands by until the next processing. Meanwhile, if shutdown pre-processing does not have started (No at Step S13), the controller 302 starts shutdown pre-processing (Step S15) and stands by until the next processing. The reason why this processing is performed is that if the state of the first electrical contact point is immediately changed to an open state, AC power is suddenly interrupted, which causes a trouble.

If the controller 302 determines such that shutdown pre-processing is completed or is not necessary at Step S12 (Yes at Step S12), no trouble occurs even though the state of the first electrical contact point is immediately changed to an open state. Accordingly, the controller determines whether an electromagnet ON signal has been output (Step S16) in which the electromagnet ON signal is a signal for making the states of the switch circuits (1) and (2), which are the first electrical contact point, become an open state. Further, if the electromagnet ON signal does not have been output (No at Step S16), the controller 302 outputs the electromagnet ON signal (the current flowing in the electromagnet, a control signal for changing the state of the current of the electromagnet to an ON state from an OFF state, or the like) (Step S17) and stands by until the next processing. Accordingly, current flows in the switch contact point lever ON-to-OFF operation electromagnet coil 4*b* of the electromagnet, so that the electromagnet is turned on.

If the electromagnet ON signal has been output in Step S16 (Yes at Step S16), the controller 302 checks whether a predetermined time has passed since the output of the electromagnet ON signal in Step S17 (Step S18). Further, if the controller fails to check that a predetermined time has passed (No at Step S18), the controller stands by until the next processing. Meanwhile, if the controller successfully checked that a predetermined time has passed at Step S18 (Yes at Step S18), the states of the switch circuits (1) and (2), which are the first electrical contact point, become an open state and a contact point OFF state by an electromagnetic force. Accordingly, the controller outputs an electromagnet OFF signal (Step S19) and stands by until the next processing. Here, the electromagnet OFF signal is a signal for turning the electromagnet off by stopping the current flowing in the electromagnet. A control signal for stopping the flowing current, a control signal for changing the state of the current of the electromagnet to an OFF state from an ON state, and the like may be used as the electromagnet OFF signal. However, the electromagnet OFF signal is not limited thereto.

Meanwhile, the controller outputs an electromagnet OFF signal (Steps S18 and S19) in this embodiment if a predetermined time has passed since the output of the electromagnet ON signal. However, the controller may be adapted to stand by until the next processing without performing Steps S18 and S19 if an electromagnet ON signal is output (Yes at Step S16). Since the supply of power to the 5VE power source 301 from the AC input 306 is stopped due to a contact point OFF state of the first electrical contact point (switch circuits (1) and (2)) later, the energy of current which is made to flow in the electromagnet by the controller 302 is also automatically lost. In the flowchart of FIG. 4, a rectangular area represented by a dotted line may be changed to a circular area represented by a solid line.

In this embodiment as described above, even when the switch manipulation portion 1 is manipulated to an OFF position from an ON position, the first electrical contact point does not immediately enter an open state but maintains a contact point ON state. That is, the current is made to flow in the electromagnet after the completion of the shutdown preprocessing, so that the state of the first electrical contact point becomes an open state (a contact point OFF). Accordingly, even though the switch manipulation portion 1 is suddenly manipulated to an OFF position, it may be possible to safely stop an apparatus on which the switch device is mounted. Further, when the apparatus is not used, it may be possible to interrupt AC power by the switch device. Furthermore, since unnecessary power consumption is small both when the apparatus is operating and when a power source is turned off, it may be possible to reduce power consumption. Moreover, since space required for the switch or necessary parts is very small, it may be possible to save space for the switch device. In addition, it may be possible to provide a switch device of which manufacturing cost is further reduced as compared with the related art.

Next, modifications of the first embodiment will be described.

First Modification of First Embodiment

In the first embodiment, the power of the electromagnet, which makes the state of the first electrical contact point become a contact point OFF state, is supplied from the controller. However, the invention is not limited thereto. In the first modification, power of the electromagnet is generated from AC lines.

Figure 5:
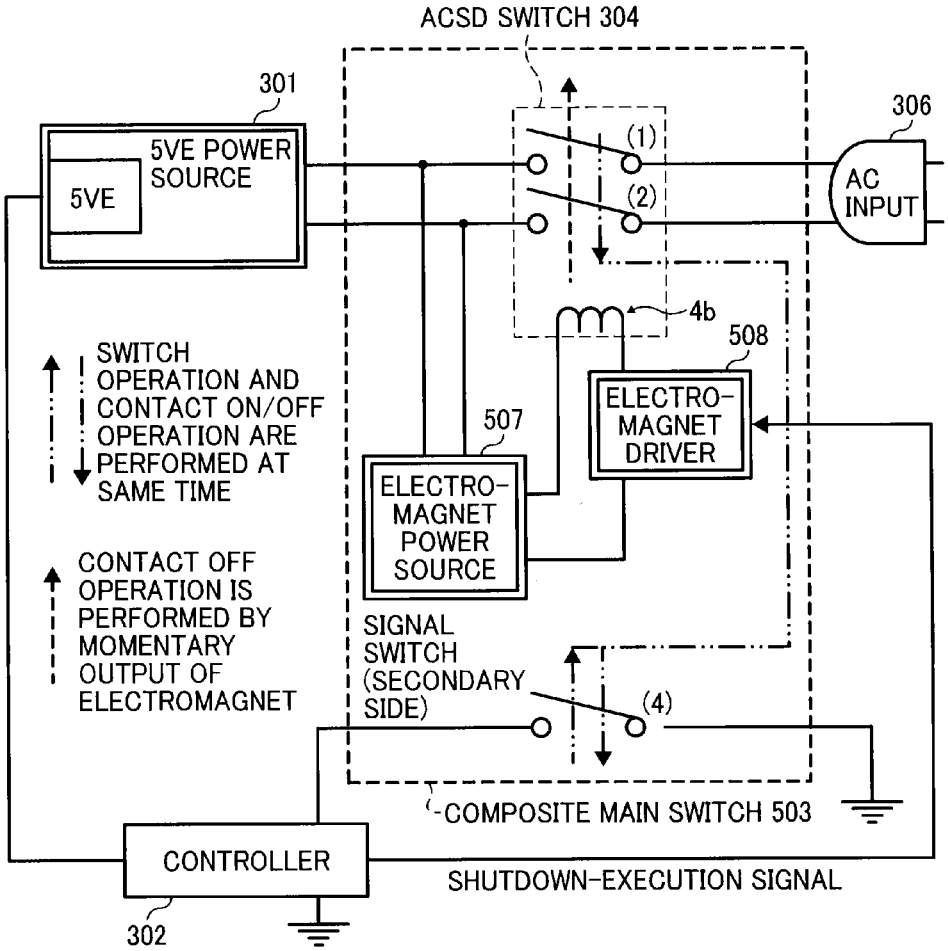
FIG. 5 is a circuit diagram illustrating the flow of a signal and the operation of a contact point of a switch according to a first modification of the first embodiment.

FIG. 5 is a circuit diagram illustrating the flow of a signal and the operation of a contact point of a switch of the first modification of the first embodiment. The structure of a switch body 10 and the structure, which changes the state of the first electrical contact point to a contact point OFF state from a contact point ON state, of this modification are the same as those of FIGS. 1 and 2 that have been described in the first embodiment.

As shown in FIG. 5, a circuit structure of a first modification mainly includes a 5VE power source 301, a controller 302, and a composite main switch 503. Here, the structures and functions of the 5VE power source 301 and the controller 302 are the same as those of the first embodiment.

The composite main switch 503 of the first modification includes an ACSD switch 304 that includes switch circuits (1) and (2) and an electromagnet (switch contact point lever ON-to-OFF operation electromagnet coil 4*b*), a signal switch (4), an electromagnet power source 507, and an electromagnet driver 508. Here, the function and structure of the ACSD switch 304 are the same as those of the first embodiment.

The electromagnet power source 507 is a power source of the electromagnet (switch contact point lever ON-to-OFF operation electromagnet coil 4*b*). As shown in FIG. 5, the electromagnet power source 507 obtains power from AC lines that are positioned behind an AC input 306, which is a commercial power source, with the switch circuits (1) and (2) interposed there between, and generates power suitable to turn the electromagnet on. Here, the generated power may be DC power or AC power, or the power of the AC lines may be directly transmitted in some cases.

The electromagnet driver 508 turns the electromagnet on and off based on a control signal sent from the controller 302. Since the electromagnet driver 508 is provided in this modification, there is no problem even if the control signal output from the controller 302 has low energy (low current).

The electromagnet driver 508 receives a control signal output from the controller 302 and can make the electromagnet power source 507 supply or interrupt power to the electromagnet (supply or interrupt current to the electromagnet). The electromagnet driver 508 may be formed of a relay circuit or a semiconductor switching element, or may be formed of a circuit including a triac and the like in the case of AC power.

Meanwhile, the control processing, which is performed by the controller 302 of this embodiment, is the same as that of the first embodiment that has been described with reference to FIG. 4.

Since the electromagnet power source 507 is provided inside the composite main switch 503 in the first modification, the controller 302 does not need to be provided with a power source for turning the electromagnet on. Accordingly, it may be possible to obtain an advantage of increasing the degree of freedom in the design of the controller 302.

Second Modification of the First Embodiment

The second modification is a system including a timer circuit switch. The timer circuit switch draws power from AC lines and generates the power for an electromagnet that changes the state of the first electrical contact point to a contact point OFF state from a contact point ON state. The timer circuit switch also makes the state of the first electrical contact point become an OFF state by turning the electromagnet on after a predetermined time has passed if the switch itself detects that the switch manipulation portion 1 is manipulated to an OFF position.

Figure 6:
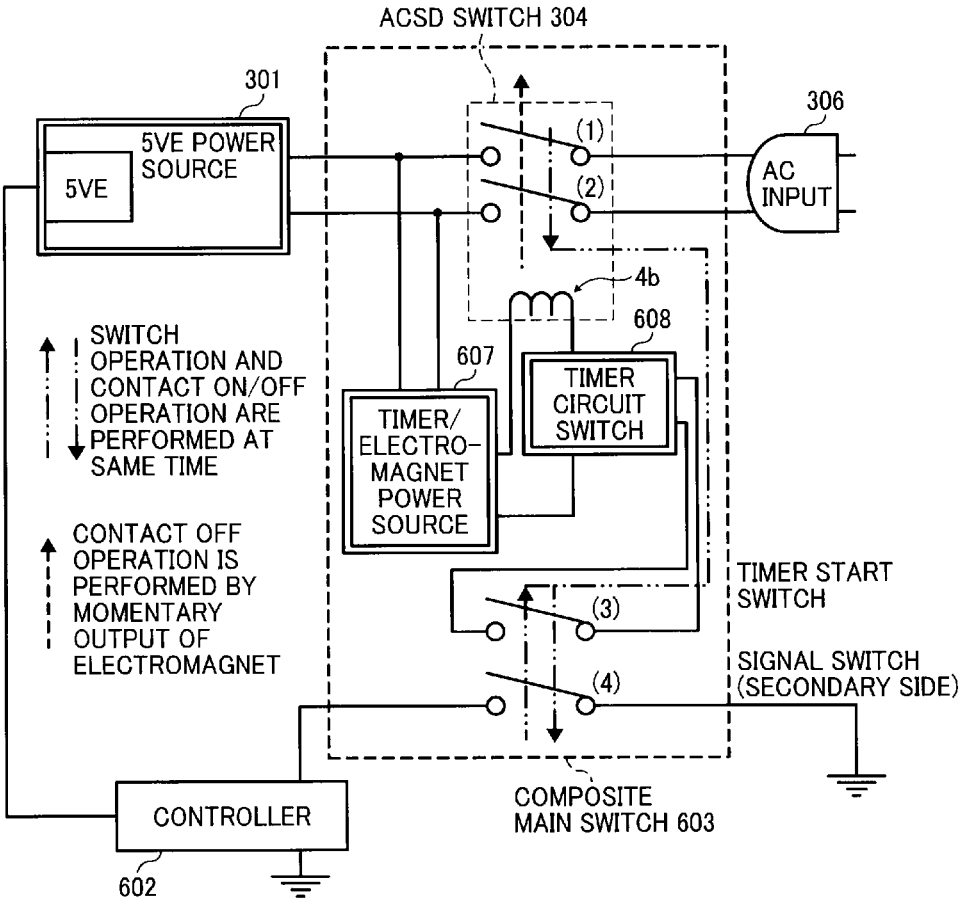
FIG. 6 is a circuit diagram illustrating the flow of a signal and the operation of a contact point of a switch according to a second modification of the first embodiment.

FIG. 6 is a circuit diagram illustrating the flow of a signal and the operation of a contact point of a switch of a second modification of the first embodiment. The structure of a switch body 10 and the structure, which changes the state of the first electrical contact point to a contact point OFF state from a contact point ON state, of this modification are the same as those of FIGS. 1 and 2 that have been described in the first embodiment.

As shown in FIG. 6, a circuit structure of the second modification mainly includes a 5VE power source 301, a controller 602, and a composite main switch 603. Here, the structure and function of the 5VE power source 301 are the same as those of the first embodiment.

The composite main switch 603 of the second modification includes an ACSD switch 304 that includes switch circuits (1) and (2) and an electromagnet (switch contact point lever ON-to-OFF operation electromagnet coil 4*b*), a timer start switch (3), a signal switch (4), a timer/electromagnet power source 607, and a timer circuit switch 608. Here, the function and structure of the ACSD switch 304 are the same as those of the first embodiment.

The timer/electromagnet power source 607 is a power source for the timer circuit switch 608 and the electromagnet (switch contact point lever ON-to-OFF operation electromagnet coil 4*b*). As shown in FIG. 6, the timer/electromagnet power source 607 obtains power from AC lines that are positioned behind an AC input 306, which is a commercial power source, with the switch circuits (1) and (2) interposed therebetween, and generates power.

The timer/electromagnet power source 607 is connected to the switch contact point lever ON-to-OFF operation electromagnet coil 4*b* of the electromagnet through the timer circuit switch 608. A signal output from the timer start switch (3) (which may be a separate detection means such as a photo-interrupter) is input to the timer circuit switch 608. If the switch manipulation portion 1 is manipulated to an OFF position, the state of the timer start switch (3) becomes an open state and a contact point OFF state, the time count, which is performed by a timer circuit (not shown), starts so that a predetermined time is counted. A switch ON function of the timer circuit switch 608 acts to turn the electromagnet on when a predetermined time elapses.

Meanwhile, a switch portion of the timer circuit switch 608 is the same as the electromagnet driver 508 of the first modification of the first embodiment shown in FIG. 5. In other words, the timer circuit switch 608 includes a timer circuit, which outputs an ON signal to the electromagnet driver 508, in addition to the electromagnet driver 508.

Further, when the switch manipulation portion 1 is manipulated to an OFF position, the state of the signal switch (4) also becomes an open state and a contact point OFF state at the same time. Accordingly, when a contact point OFF state is detected, the controller 602 immediately performs a shutdown pre-processing. That is, unlike in the first embodiment and the first modification of the first embodiment, the states of the switch circuits (1) and (2), which are the first electrical contact point, forcibly become an open state and a contact point OFF state after a predetermined time in the second modification. For this reason, the controller 602 needs to reliably complete shutdown pre-processing by this point of time. Accordingly, the predetermined time needs to be set to be equal to or longer than the time that is required to complete the shutdown pre-processing.

Figure 7:
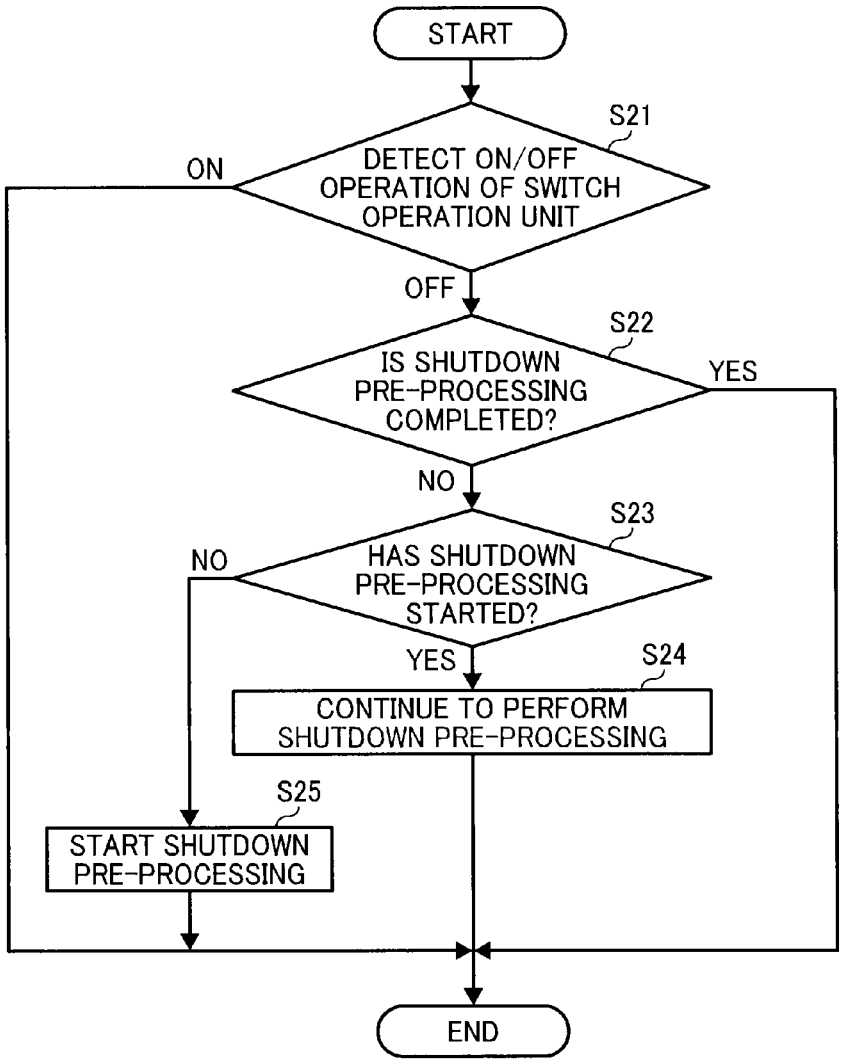
FIG. 7 is a flowchart illustrating a procedure of control processing that is performed by a controller of the second modification of the first embodiment.

FIG. 7 is a flowchart illustrating a procedure of the control processing that is performed by the controller 602 of the second modification of the first embodiment.

First, the controller 602 detects which position of an ON position and an OFF position the switch manipulation portion 1 is positioned at, by detecting the open/closed state of the second electrical contact point, that is, the signal switch (4) (Step S21).

Further, if the switch manipulation portion 1 is positioned at an ON position (ON at Step S21), the controller 602 stands by until the next processing. Meanwhile, if the switch manipulation portion 1 is positioned at an OFF position (OFF at Step S21), the controller 602 determines whether shutdown pre-processing has been completed or whether shutdown pre-processing is not necessary (Step S22).

Furthermore, if the controller determines that shutdown pre-processing has not been completed or is necessary (No at Step S22), the controller 602 determines whether shutdown pre-processing has started (Step S23). Moreover, if shutdown pre-processing has started (Yes at Step S23), the controller 602 continues to perform shutdown pre-processing (Step S24) and stands by until the next processing. Meanwhile, if shutdown pre-processing does not have started (No at Step S23), the controller 602 starts shutdown pre-processing (Step S25) and stands by until the next processing.

FIG. 7 is different from FIG. 4 in that the processing of Steps S16, S17, S18, and S19 are not necessary. In the systems illustrated in FIG. 6, FIG. 13 (to be described below), and FIG. 14 (to be described below), the timer function of the switch itself automatically makes the state of the first electrical contact point (the switch circuits (1) and (2)) become an open state and a contact point OFF state after a predetermined time, so that the processing of Steps S16, S17, S18, and S19 is performed.

In the second modification, the timer function of the composite main switch 603 itself automatically makes the state of the first electrical contact point (the switch circuits (1) and (2)) become an open state and a contact point OFF state after a predetermined time. Accordingly, the output of an electromagnet ON signal like in the first embodiment is not performed.

In the second modification, the timer function of the composite main switch 603 itself automatically makes the state of the first electrical contact point (the switch circuits (1) and (2)) become an open state and a contact point OFF state after a predetermined time. For this reason, the controller 602 does not need to be provided with a power source for turning the electromagnet on or does not need to output a control signal such as an electromagnet ON signal. Accordingly, it may be possible to increase the degree of freedom in the design of the controller 602 as compared with the first modification.

Third Modification of First Embodiment

Figure 8A:
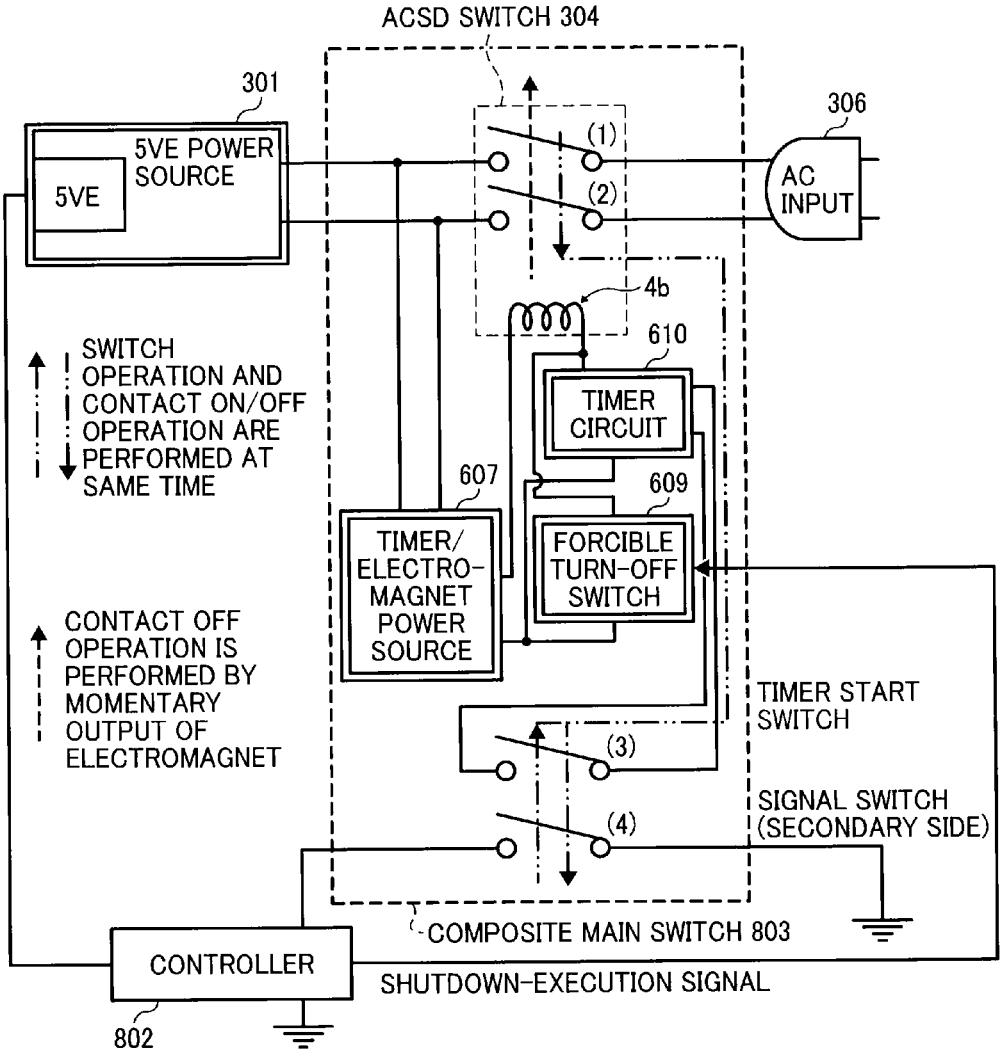
FIG. 8A is a circuit diagram illustrating the flow of a signal and the operation of a contact point of a switch according to a third modification of the first embodiment.

FIG. 8A is a circuit diagram illustrating the flow of a signal and the operation of a contact point of a switch of a third modification of the first embodiment. The structure of a switch body 10 of this modification is the same as that of FIGS. 1 and 2 that have been described in the first embodiment.

As shown in FIG. 8A, a circuit structure of the third modification mainly includes a 5VE power source 301, a controller 802, and a composite main switch 803. Here, the structure and function of the 5VE power source 301 are the same as those of the first embodiment.

The composite main switch 803 of the third modification includes an ACSD switch 304 that includes switch circuits (1) and (2) and an electromagnet (switch contact point lever ON-to-OFF operation electromagnet coil 4*b*), a timer start switch (3), a signal switch (4), a timer/electromagnet power source 607, a timer circuit 610, and a forcible turn-off switch 609. Here, the function and structure of the ACSD switch 304 are the same as those of the first embodiment; and the function of the timer/electromagnet power source 607 is the same as that of the second modification of the first embodiment.

The third modification is different from the second modification in that the forcible turn-off switch 609 is provided in the third modification. The forcible turn-off switch 609 is connected in parallel to the timer circuit 610. When a shutdown-execution signal is input to the forcible turn-off switch 609 from the controller 802, the forcible turn-off switch 609 controls the electromagnet (switch contact point lever ON-to-OFF operation electromagnet coil 4*b*) so that the electromagnet controls ON-control.

That is, if a shutdown-execution signal is input to the forcible turn-off switch from the controller 802 by the determination of the controller 802 in the third modification even though the switch manipulation portion 1 is positioned at an ON position, the forcible turn-off switch controls the electromagnet (switch contact point lever ON-to-OFF operation electromagnet coil 4*b*) so that the electromagnet controls ON-control. Accordingly, it may be possible to forcibly change the state of the first electrical contact point to an OFF state from an ON state and to change the position of the switch manipulation portion 1 to an OFF position from an ON position.

Figure 8B:
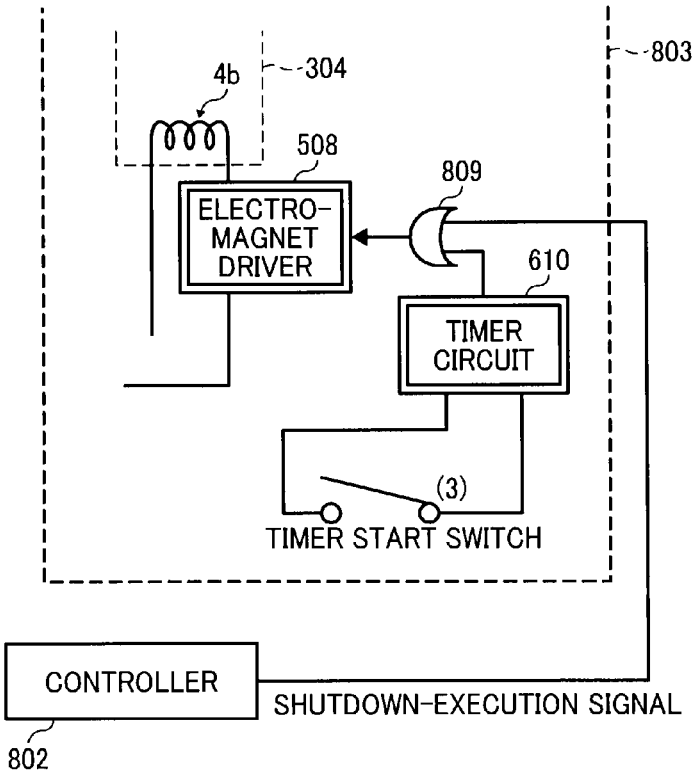
FIG. 8B is a circuit diagram illustrating another example of the switch of the third modification of the first embodiment.

Meanwhile, as shown in FIG. 8B, the structure of a switch portion of the third modification of the first embodiment shown in FIG. 8A may use the electromagnet driver 508 of the first modification of the first embodiment shown in FIG. 5; connect an OR circuit 809 to the electromagnet driver 508; and input a signal, which corresponds to the logical sum of an electromagnet ON signal output from the timer circuit 610 and the shutdown-execution signal output from the controller 802, to the electromagnet driver by the OR circuit 809. Meanwhile, FIG. 8B shows only the electromagnet (switch contact point lever ON-to-OFF operation electromagnet coil 4*b*), the electromagnet driver 508, the OR circuit 809, the timer circuit 610, the timer start switch (3), and the controller 802.

This structure can also change the state of the first electrical contact point to an OFF state from an ON state and change the position of the switch manipulation portion 1 to an OFF position from an ON position by making current forcibly flow in the electromagnet (switch contact point lever ON-to-OFF operation electromagnet coil 4*b*) by the determination of the controller 802 even though the switch manipulation portion 1 is positioned at an ON position.

Second Embodiment

In the first embodiment, the state of the first electrical contact point has been changed to a contact point OFF state from a contact point ON state by using the electromagnet. However, in this embodiment, the state of the first electrical contact point is changed to a contact point OFF state from a contact point ON state by using a bimetal.

In this embodiment, the structure of a switch body 10 is the same as that of FIG. 1 that has been described in the first embodiment. The structure of a mechanism, which changes the state of the first electrical contact point to an open state (a contact point OFF state) from a closed state (a contact point ON state), of this embodiment is different from that of the first embodiment.

Figure 9:
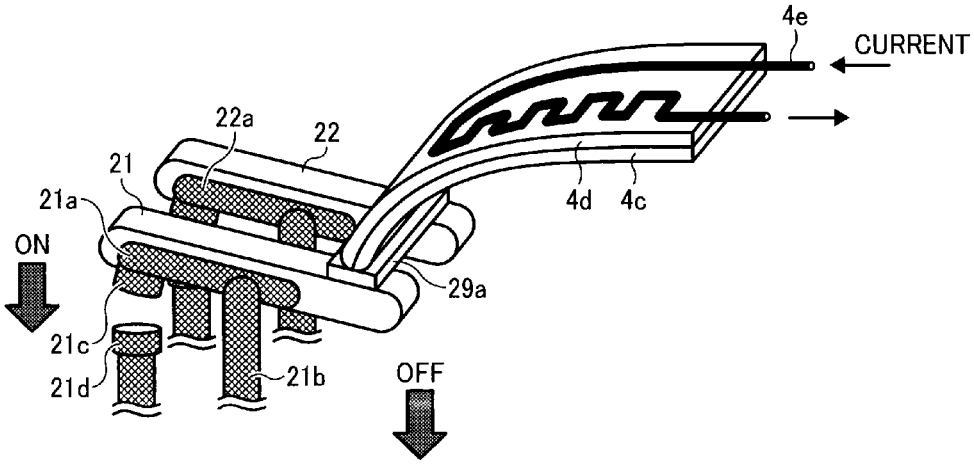
FIG. 9 is a schematic view showing the structure of a mechanism, which changes the state of a first electrical contact point to an open state (a contact point OFF state) from a closed state (a contact point ON state), in a switch device according to a second embodiment.

FIG. 9 is a schematic view showing the structure of a mechanism, which changes the state of a first electrical contact point to an open state (a contact point OFF state) from a closed state (a contact point ON state), of a switch device according to a second embodiment. FIG. 9 shows only portions that are positioned below first switch contact levers 21 and 22, and shows that the state of the electrical contact point becomes an open state (a contact point OFF state) by a bimetal. Further, FIG. 9 shows a state where current flows in a bimetal heating heater wire 4*e* and the state of the first electrical contact point becomes an open state (a contact point OFF state) after a switch manipulation portion 1 is manipulated to an OFF position.

When the switch manipulation portion 1 is manipulated to an OFF position from an ON position, the state of a second electrical contact point (a second switch contact lever-side contact point and a second switch terminal-side contact point) becomes an open state as described in the first embodiment. However, the first electrical contact point (a first switch contact lever-side contact point 21*c* and a first switch terminal-side contact point 21*d*, and a first switch contact lever-side contact point (not shown) and a first switch terminal-side contact point (not shown) corresponding to the first switch contact lever 22) maintains a contact state, and the state of the first electrical contact point remains a closed state (a contact point ON state).

As shown in FIG. 9, in the switch body 10 shown in FIG. 1, a switch contact point lever ON-to-OFF operation plate 29*a*, which operates the switch contact lever so that the state of the switch contact lever is changed to an OFF state from an ON state is joined to the upper surfaces of the first switch contact levers 21 and 22. The first switch contact levers 21 and 22 are interlocked with each other in terms of operation.

Further, an end portion (left end portion in FIG. 9) of a bimetal material 4*c* and 4*d* is positioned above the upper surface of the switch contact point lever ON-to-OFF operation plate 29*a*, and the bimetal metal 4*c* and 4*d* come into contact with the upper surface of the switch contact point lever ON-to-OFF operation plate 29*a* when the bimetal is bent. The other end portion (right end portion in FIG. 9) of the bimetal 4*c* and 4*d* are fixed by a fixing member (not shown).

The bimetal (Bi-metallic strip) is a member that is formed by bonding two metal plates (bimetal materials) having different coefficients of thermal expansion. In this embodiment a bimetal material 4*c* having a small coefficient of thermal expansion is positioned on the lower side; a bimetal material 4*d* having a large coefficient of thermal expansion is positioned on the upper side; and the bimetal materials are bonded to each other. Furthermore, the bimetal heating heater wire 4*e* is disposed on the bimetal material 4*d* having a large coefficient of thermal expansion.

In this embodiment, current is made to flow in the bimetal heating heater wire 4*e* by a circuit structure to be described below. Accordingly, the bimetal 4*c* and 4*d* is bent downward as shown in FIG. 9 due to the difference of the coefficients of thermal expansion between two kinds of metal. Moreover, the moving end portions (left end portions in FIG. 9) of the bimetal 4*c* and 4*d* presses the switch contact point lever ON-to-OFF operation plate 29*a* down from above due to the bending of the bimetal, and the right portions of the first switch contact levers 21 and 22 in FIG. 9 are pushed down by the pressing force of the bimetal. Accordingly, the contact state (closed state) of the first electrical contact point (that is, the first switch contact lever-side contact point 21*c* and the first switch terminal-side contact point 21*d*, and the first switch contact lever-side contact point (not shown) and the first switch terminal-side contact point (not shown) corresponding to the first switch contact lever 22) is canceled; and the state of the first electrical contact point is changed to an open state (a contact point OFF state). Here, current, which flows in the bimetal heating heater wire 4*e*, may be any one of direct current and alternate current.

Further, FIG. 9 shows a state where current flows in the bimetal heating heater wire 4*e*, the bimetal 4*c* and 4*d* is bent, and the states of the first switch contact lever-side contact point 21*c* and the first switch terminal-side contact point 21*d* become a contact point OFF state. However, when current does not flow in the bimetal heating heater wire 4*e*, the bimetal 4*c* and 4*d* is substantially horizontal instead of being bent. Accordingly, the first switch contact lever-side contact point 21*c* and the first switch terminal-side contact point 21*d*, and the first switch contact lever-side contact point (not shown) and the first switch terminal-side contact point (not shown) corresponding to the first switch contact lever 22 may be in a contact point ON state.

Figure 10:
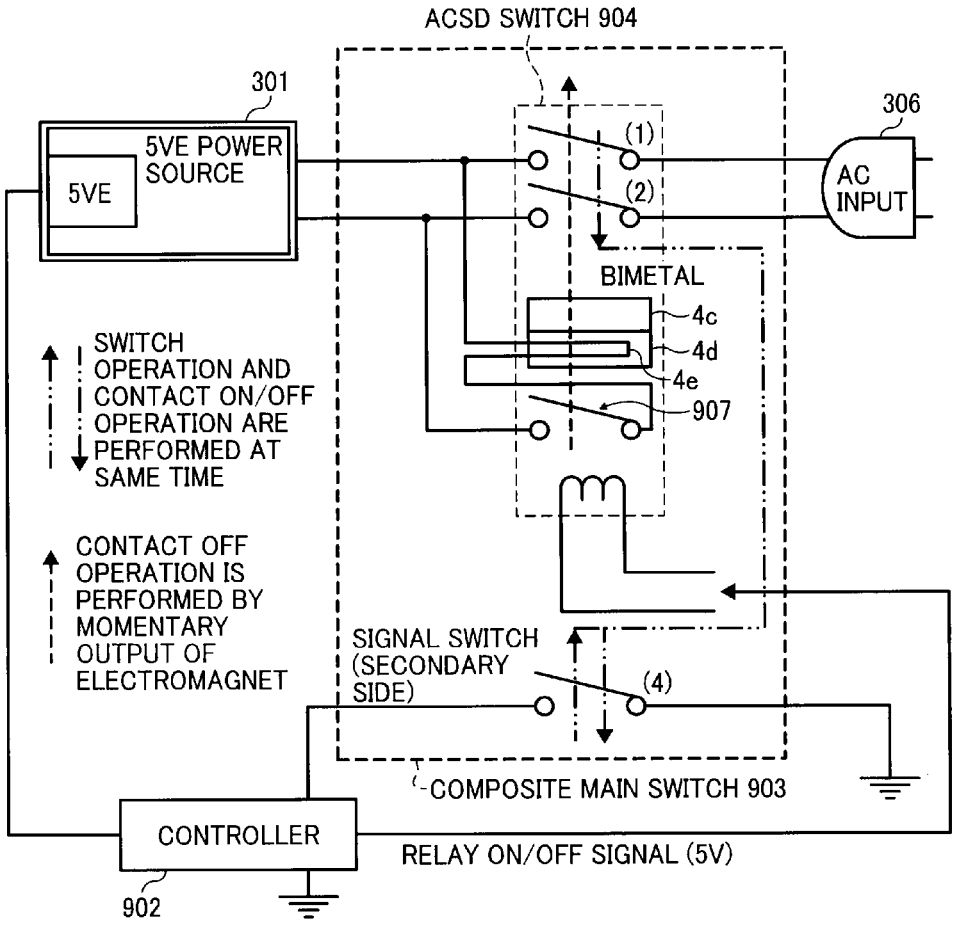
FIG. 10 is a circuit diagram illustrating the flow of a signal and the operation of a contact point of a switch of the second embodiment.

Next, there will be described a circuit structure that makes the state of the first electrical contact point become an open state by making current flow in the bimetal heating heater wire 4*e*. FIG. 10 is a circuit diagram illustrating the flow of a signal and the operation of a contact point of the switch of the second embodiment.

As shown in FIG. 10, a circuit structure of this embodiment mainly includes a 5VE power source 301, a controller 902, and a composite main switch 903. Here, the structure and function of the 5VE power source 301 are the same as those of the first embodiment.

The composite main switch 903 of this embodiment includes an ACSD switch 904, which includes switch circuits (1) and (2), the bimetal 4*c* and 4*d*, and a relay 907, and a signal switch (4). Here, the functions and structures of the switch circuits (1) and (2) and the signal switch (4) are the same as those of the first embodiment.

Power of the bimetal heating heater wire 4*e* is supplied from AC lines that are positioned behind a commercial power source AC input 306 with the switch circuits (1) and (2) interposed therebetween. When the relay 907 is turned on and current flows in the bimetal heating heater wire 4*e*, the states of the switch circuits (1) and (2), which are the first electrical contact point, become an open state and a contact point OFF state due to the deformation of the bimetal 4*c* and 4*d*.

The controller 902 detects the ON/OFF position of the switch manipulation portion 1 by detecting the open/closed state of the signal switch (4) as described in the first embodiment. When the controller 902 completely performs shutdown pre-processing, the controller outputs a relay ON signal, which is a signal for turning the relay 907 on, in order to turn the relay 907 on. Accordingly, current flows in the bimetal heating heater wire 4*e*, so that the states of the switch circuits (1) and (2) become an open state and a contact point OFF state due to the thermal deformation of the bimetal 4*c* and 4*d*.

Here, the ON control of the relay 907, which is performed by the controller 902, is sufficiently performed within a short time for example 5 seconds. For this reason, energy, which is consumed for the operation of the ON control of the relay 907, is very small. Here, it is preferable that the ON control of the relay 907 be performed for a short time by the controller 902. However, if the states of the contact points of the switch circuits (1) and (2) become an open state even though the ON control of the relay 907 continues to be performed, the supply of power to the 5VE power source 301 from the AC input 306 is stopped in this embodiment. Accordingly, the supply of power to the bimetal heating heater wire 4*e* is also automatically stopped. When the supply of power to the bimetal heating heater wire 4*e* is stopped, the bimetal 4*c* and 4*d* recover their original shapes, that is, they return to the substantially horizontal shape by natural cooling.

Figure 11:
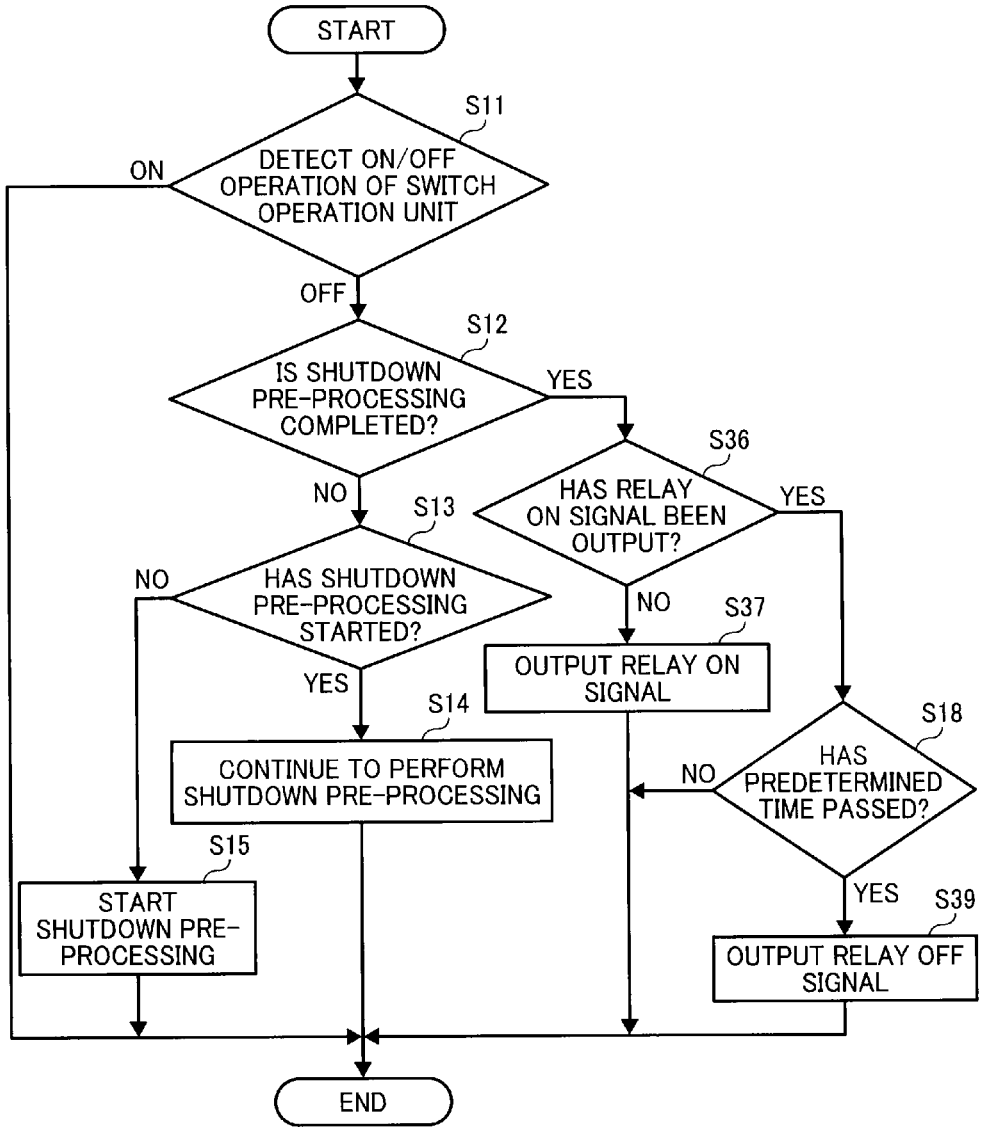
FIG. 11 is a flowchart illustrating a procedure of control processing that is performed by a controller of the second embodiment.

Next, there will be described the control of changing the state of the first electrical contact point to a contact point OFF state (open state) from a contact point ON state (closed state), which is performed by the controller 902 when the switch manipulation portion 1 is manipulated to an OFF position from an ON position. FIG. 11 is a flowchart illustrating a procedure of control processing that is performed by the controller 902 of the second embodiment.

The control processing of this embodiment is different from that of the first embodiment in terms of the processing of Steps S36, S37, and S39. The other processing of the control processing of this embodiment is the same as that of FIG. 4 that has been described in the first embodiment. That is, if the controller 902 completes shutdown pre-processing (Yes at Step S12), the controller determines whether a relay ON signal has been output (Step S36). If a relay ON signal has not been output (No at Step S36), the controller outputs a relay ON signal and turns the relay 907 on (Step S37).

Further, if a predetermined time has passed since the controller 902 outputs a relay ON signal (Yes at Step S18), current flows in the bimetal heating heater wire 4*e* and the bimetal 4*c* and 4*d* is bent, so that the states of the switch circuits (1) and (2) become an open state and a contact point OFF state. Accordingly, the controller outputs a relay OFF signal (Step S39) and turns the relay 907 off. For this reason, current does not flow in the bimetal heating heater wire 4*e*, so that the bimetal 4*c* and 4*d* returns to the substantially horizontal shape; and the contact state between the switch contact point lever ON-to-OFF operation plate 29*a* and the bimetal is canceled. Therefore, the switch circuits (1) and (2) maintain a contact point OFF state while they are in an open state. Meanwhile, as in FIG. 4, the processing of Steps S18 and S39 may not be performed even in this embodiment.

In this embodiment as described above, even when the switch manipulation portion 1 is manipulated to an OFF position from an ON position, the state of the first electrical contact point is not immediately changed to an open state but a contact point ON state is maintained. The bimetal 4*c* and 4*d* is bent after the completion of the shutdown pre-processing, so that the state of the first electrical contact point then becomes an open state and a contact point OFF state. Accordingly, even though the switch manipulation portion 1 is suddenly manipulated to an OFF position, it may be possible to safely stop an apparatus on which the switch device is mounted. Further, when the apparatus is not used, it may be possible to interrupt AC power by the switch device. Furthermore, since unnecessary power consumption is small when the apparatus is operating and a power source is turned off, it may be possible to reduce power consumption. Moreover, since space required for the switch or necessary parts is very small, it may be possible to save space for the switch device. In addition, it may be possible to provide a switch device of which manufacturing cost is further reduced as compared with the related art.

Examples of the related art of the first and second embodiments will be described below.

Figure 12:
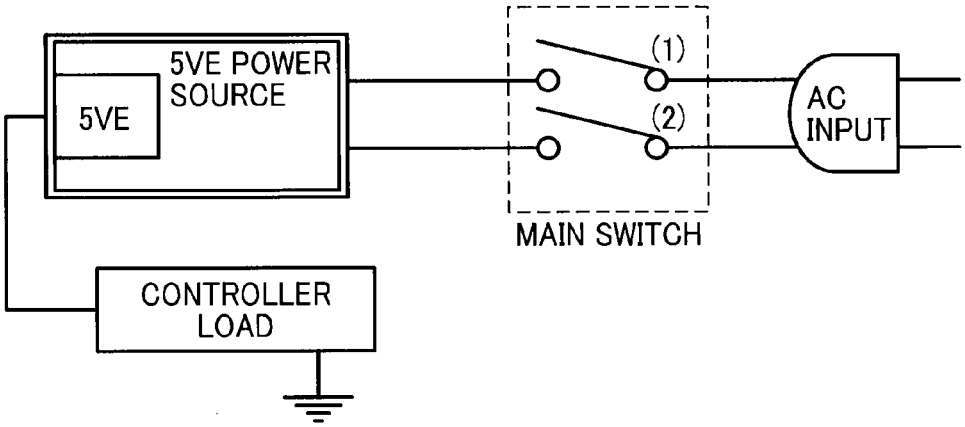
FIG. 12 is a circuit diagram illustrating the flow of a signal and the operation of a contact point of a switch in the first related art.

A system in the first related art shown in FIG. 12 is a system that is generally used for many apparatuses. In this system, a so-called main switch is mounted to turn a commercial power source AC input 306 between on and off; and the supply and interruption of power to a power supply unit are performed in synchronization with the manipulation of the switch.

The merits of this system are that it incurs a low cost because it is built up with using a smaller number of parts, and the circuit thereof is simple. Meanwhile, the demerit of this system is that safe stop cannot be achieved when the switch is suddenly turned off. For this reason, this system may cause a serious problem, such as the destruction of a hard disk, the loss of communication data, and the loss of stored data, in some cases.

Figure 13:
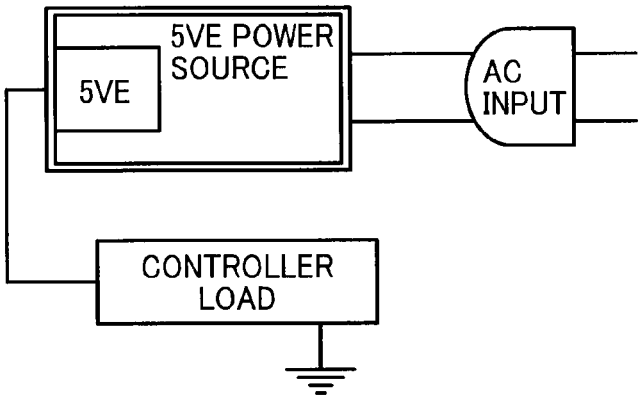
FIG. 13 is a circuit diagram illustrating the flow of a signal and the operation of a contact point of a switch in the second related art.

A system in the second related art shown in FIG. 13 is a system that is generally used for some apparatuses, such as a computer, a liquid crystal projector, and the like. Commercial power AC is directly input to a power supply unit without using a switch. The merit of this system is that safe stop can be reliably performed when the use of an apparatus is finished because a switch is not suddenly turned off. Meanwhile, as the demerit of this system, there is a problem in that a user cannot interrupt power by a switch, that is, a user feels troublesome in using the system and power is unnecessarily consumed as long as an apparatus is not unplugged.

Figure 14:
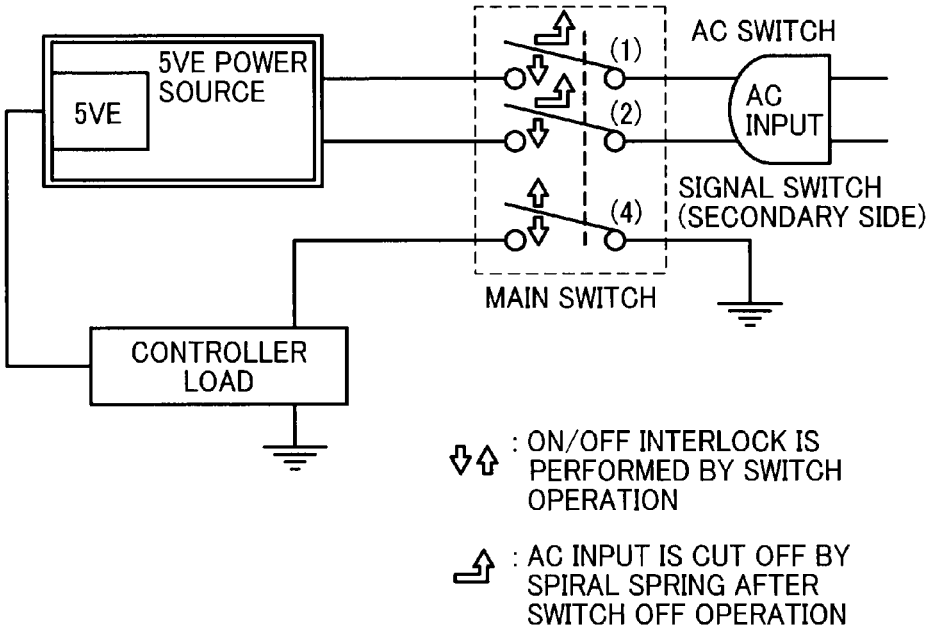
FIG. 14 is a circuit diagram illustrating the flow of a signal and the operation of a contact point of a switch in the third related art.

A system in the third related art shown in FIG. 14 is a system that corresponds to a technique of a so-called extractor fan switch of a bathroom. In this system, a signal switch (4) enters a closed state (a contact point ON state) or an open state (a contact point OFF state) in real time by an interlocking operation with the manipulation of the switch manipulation portion 1. When a controller detects the OFF manipulation of the switch manipulation portion 1 by the signal switch (4), the controller immediately performs shutdown pre-processing. When the switch manipulation portion 1 is manipulated to an ON position, the states of AC switches (1) and (2) simultaneously become a closed state (a contact point ON state) and spiral springs are wound. When the switch manipulation portion 1 is manipulated to an OFF position, spiral spring OFF timers start to operate and the states of the AC switches (1) and (2) automatically become an open state (a contact point OFF state) after 1 to 2 minutes from the starting. The merits of this system are that there is no unnecessary power consumption and a commercial power source AC input 306 is cut off by the spiral spring timers after a predetermined time. Meanwhile, the demerits of this system are that a mechanism is slightly complicated and cost is incurred.

An example of an actual switch for a bathroom is WN5276 that is manufactured by Panasonic Electric Works Co., Ltd. The switch circuits (1) and (2) may function as extractor fan switching means of WN5276, and the signal switch (4) may function as lamp switching means of WN5276.

Figure 15:
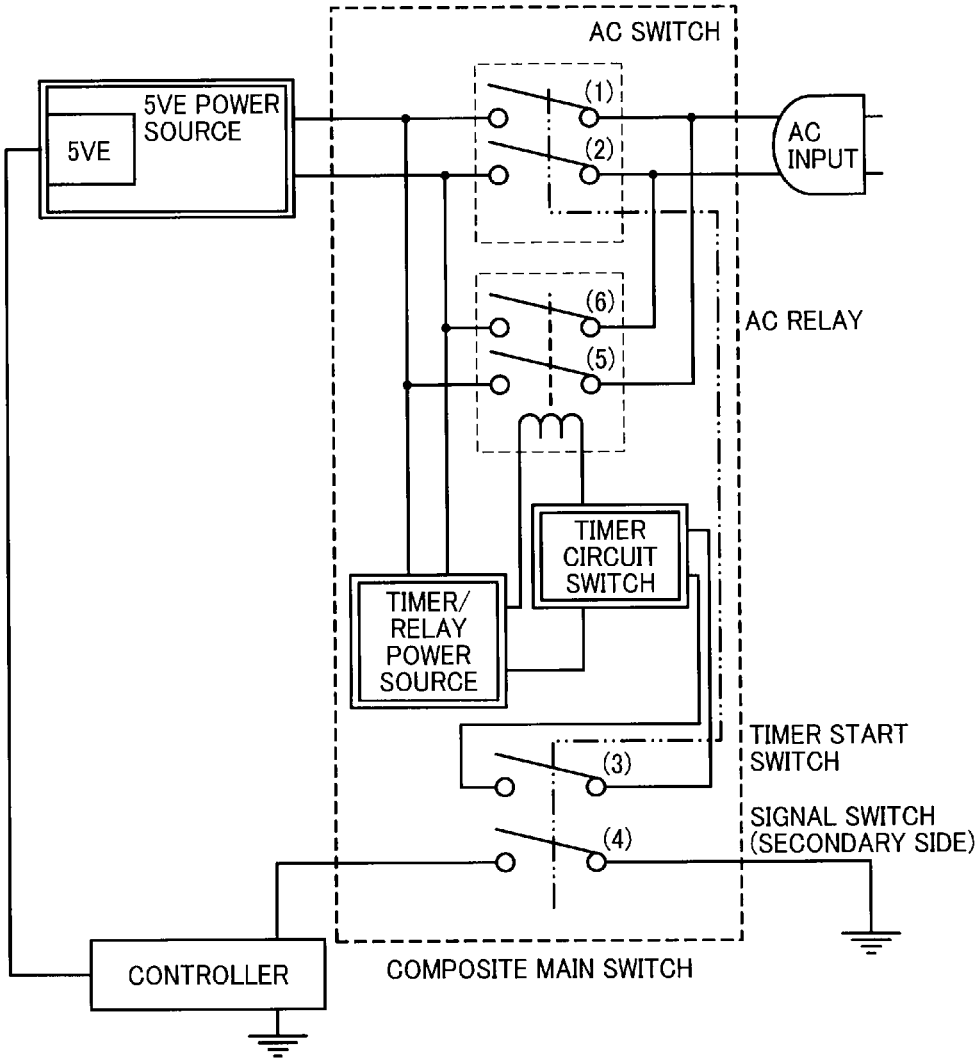
FIG. 15 is a circuit diagram illustrating the flow of a signal and the operation of a contact point of a switch in the fourth related art.

A system in the fourth related art shown in FIG. 15 is a system where an existing AC switch and an existing DC switch are combined with an existing relay. In this system, the switches (1), (2), (3), and (4) enter a closed state (a contact point ON state) or an open state (a contact point OFF state) in real time by an interlocking operation with the manipulation of the switch manipulation portion 1. Further, when the states of the switches (1) and (2) become a closed state (a contact point ON state), AC power is supplied to a 5VE power source and a power source for a timer and a relay. When AC power is supplied to the power source for a timer and a relay, the state of a timer circuit switch becomes a contact point ON state and current is supplied to the relay. Accordingly, the states of the switches (5) and (6) become a contact point ON state. When the change of the manipulation of the switch manipulation portion 1 to an OFF position from an ON position is detected by the timer start switch (3) or the like, an OFF timer of the relay starts and the current supplied to the relay is cut off after a predetermined time has passed since the starting of the OFF timer (for example, after one (1) second or more from the starting of the OFF timer).

The controller detects the ON/OFF position of the switch manipulation portion 1 by the signal switch (4). When the controller detects the OFF position of the switch manipulation portion 1, the controller immediately performs shutdown pre-processing and completes the shutdown pre-processing before the current supplied to the relay is interrupted.

After the current supplied to the relay is interrupted, the states of the switches (5) and (6) become an open state (a contact point OFF state). The switch (3) and the like may be disposed on any one of the primary side and the secondary side, but the switch (4) is disposed on the secondary side.

The merit of this system is that safe shutdown can be performed since the relay connected in parallel to an AC switch is turned off by a timer after the safe stop is reliably performed like the system illustrated in FIG. 6 when the use of an apparatus has been completed. Meanwhile, the demerits of this system are that power is unnecessarily consumed to excite the relay during the use of an apparatus; the circuit structure is complicated; and cost and space are large.

Figure 16:
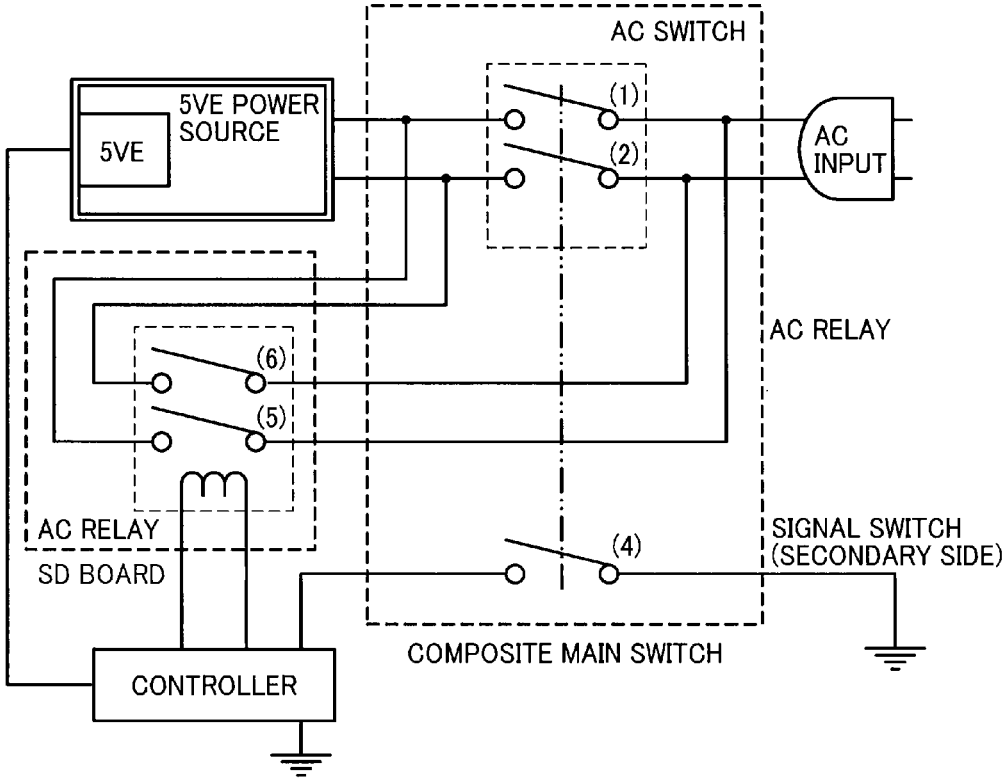
FIG. 16 is a circuit diagram illustrating the flow of a signal and the operation of a contact point of a switch in the fifth related art.

A system in the fifth related art shown in FIG. 16 is a system where a switch itself turns both of a commercial power source AC input 306 and a signal switch on/off in real time; and a relay circuit connected in parallel to an AC switch is always turned on in the case in which the cut-off of the commercial power source AC input 306 is likely to cause a trouble, while the ON/OFF state of the switch is detected by a controller. In this system, the switches (1), (2), and (4) enter a closed state (a contact point ON state) or an open state (a contact point OFF state) in real time by an interlocking operation with the ON/OFF manipulation of the switch manipulation portion 1. When the states of the switches (1) and (2) become a contact point ON state, AC power is supplied to a 5VE power source. When power is supplied to the controller from the 5VE power source, the controller makes the states of switches (5) and (6) in a closed state (a contact point ON state) by supplying current to a relay if the controller determines that shutdown pre-processing is not completed or shutdown pre-processing is necessary.

The controller detects the ON/OFF position of the switch manipulation portion 1 by the open/closed state of the signal switch (4). When the controller detects the OFF position of the switch manipulation portion 1, the controller immediately performs shutdown pre-processing if necessary. When the shutdown pre-processing is completed, the controller turns the relay off. After the current supplied to the relay is interrupted, the states of the switches (5) and (6) become an open state (a contact point OFF state). The signal switch (4) is disposed on the secondary side. In this system, there is power consumption for the relay until the relay is turned off after the switch is turned on. The merits of this system are that safe shutdown can be performed since the relay is turned off by a relay control signal output from the controller, and a commercial power source AC input 306 is cut off after the controller reliably completes shutdown pre-processing when the use of an apparatus has been completed. Meanwhile, the demerits of this system are that power is unnecessarily consumed to excite the relay during the use of an apparatus, and additional cost and space are required.

Figure 17:
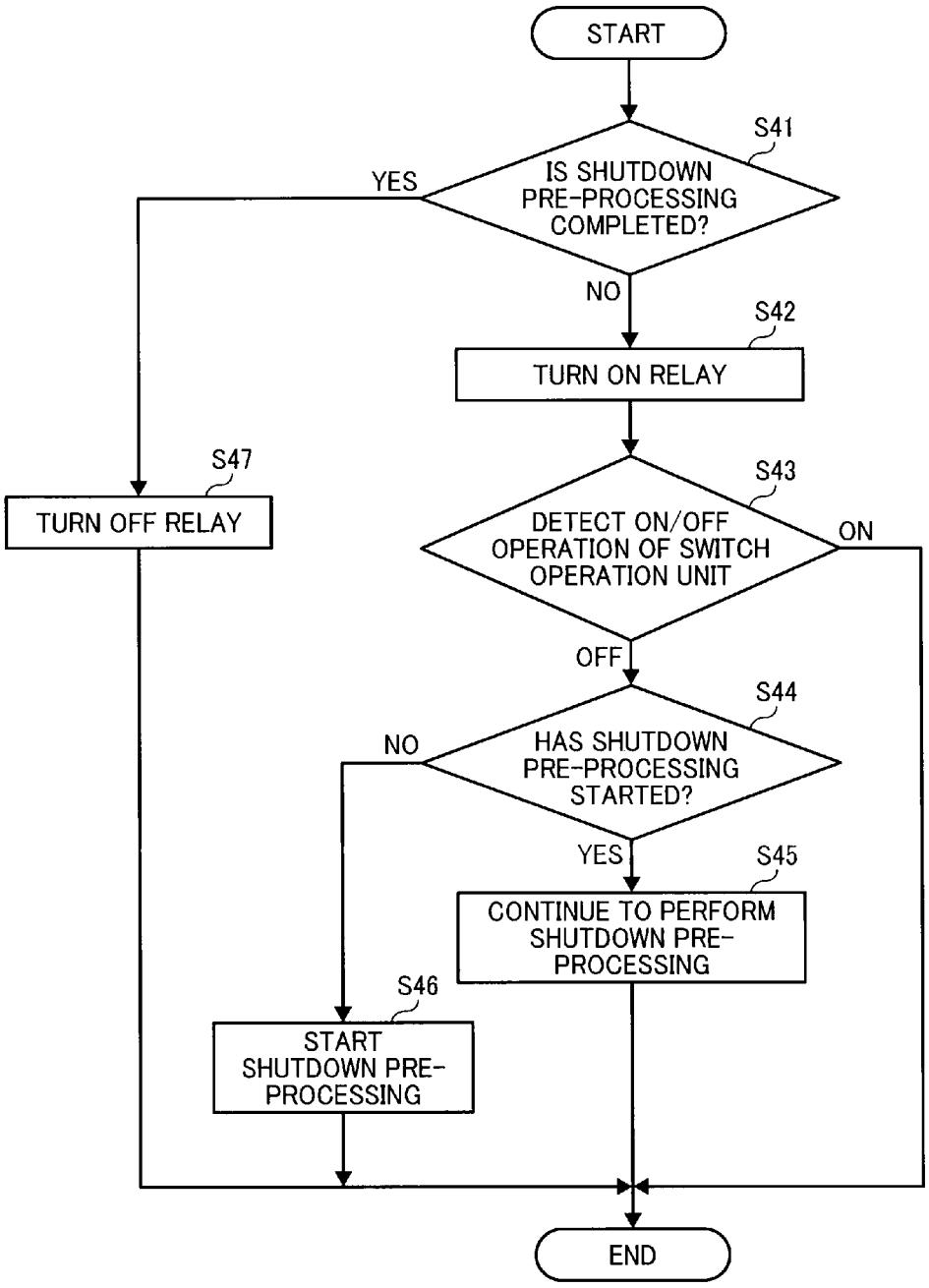
FIG. 17 is a flowchart illustrating a procedure of control processing that is performed by a controller in the fifth related art.

FIG. 17 is a flowchart illustrating a procedure of control processing that is performed by a controller in the fifth related art. The controller checks whether shutdown pre-processing has been completed or whether shutdown pre-processing is necessary (Step S41). Further, if the state of the first electrical contact point is immediately changed to an open state when the controller determines that shutdown pre-processing has not been completed or shutdown pre-processing is necessary (No at Step S41), AC power is suddenly interrupted, so that a problem occurs. For this reason, the controller turns relays on which are formed of the first electrical contact point (the switch circuits (1) and (2)) and the parallel circuit contact point (the relay circuit contact points (5) and (6)) (Step S42).

Meanwhile, if the controller determines that shutdown pre-processing has been completed or shutdown pre-processing is not necessary (Yes at Step S41), that is, if a problem is not expected to occur even though the state of the first electrical contact point is immediately changed to an open state, the controller turns the relays off (Step S47).

Then, the controller detects which position of an ON position and an OFF position the switch manipulation portion 1 is positioned at (Step S43). If the switch manipulation portion 1 is positioned at an ON position (ON at Step S43), the controller stands by until the next processing. Meanwhile, if the switch manipulation portion 1 is positioned at an OFF position (OFF at Step S43), the controller further determines whether shutdown pre-processing has started (Step S44). The processing of Steps S45 and S46, which are subsequent to Step S44, are performed in the same manner as the processing of Steps S14 and S15 of FIG. 4 that have been described in the first embodiment.

Figure 18:
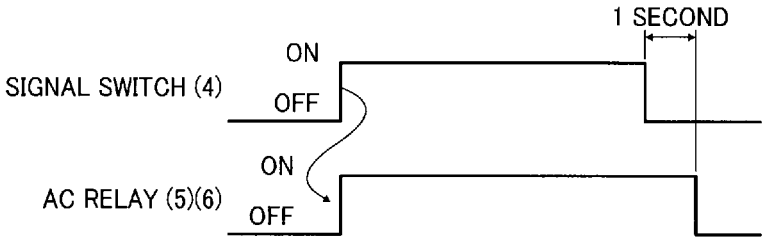
FIG. 18 is a timing diagram showing the control timing of a system that prevents a switch from being suddenly cutoff with the use of a parallel relay circuit in the fifth related art.

FIG. 18 is an example of a timing diagram showing the control timing of a system that prevents the sudden cutoff of a switch by a parallel relay circuit. When the switch manipulation portion 1 is manipulated to an ON position and the controller detects the ON position of the switch manipulation portion 1 by the signal switch (4), the controller turns the relays on so as to prevent the sudden interruption of AC power. After that, a state where the sudden interruption of AC power is avoided is maintained. When the switch manipulation portion 1 is manipulated to an OFF position, the controller immediately performs shutdown pre-processing. After the controller completes shutdown pre-processing, the controller turns the relays (5) and (6) off. Alternatively, shutdown pre-processing starts at the same time when the OFF manipulation of the switch manipulation portion 1 is turned to OFF operation, and the controller turns the relays (5) and (6) off after one second passes from a point of time where the shutdown pre-processing is expected to be completed. (FIG. 18 is a timing diagram showing the latter case.)

As compared the examples of the related art with the first and second embodiments of the invention, the invention can provide a switch device that has solved the demerits of the related art, and a system including the switch device.

Problems to be solved by the invention will be described below.

(1) Even though a power switch is suddenly turned off, it may be possible to safely stop a machine.

(2) When a machine is not used, it may be possible to interrupt AC power by a power switch.

(3) It may be possible to reduce consumption of unnecessary power that is used during the operation of a machine (AC is not made to flow by relays).

(4) It may be possible to reduce consumption of unnecessary power that is used while a machine is in an OFF mode (a switch is turned off by pulse current).

(5) It may be possible to reduce space, which is required for the switch or necessary parts, as much as possible.

(6) It may be possible to provide a switch device that may be manufactured at a low cost as compared to the related art.

Figure 19:
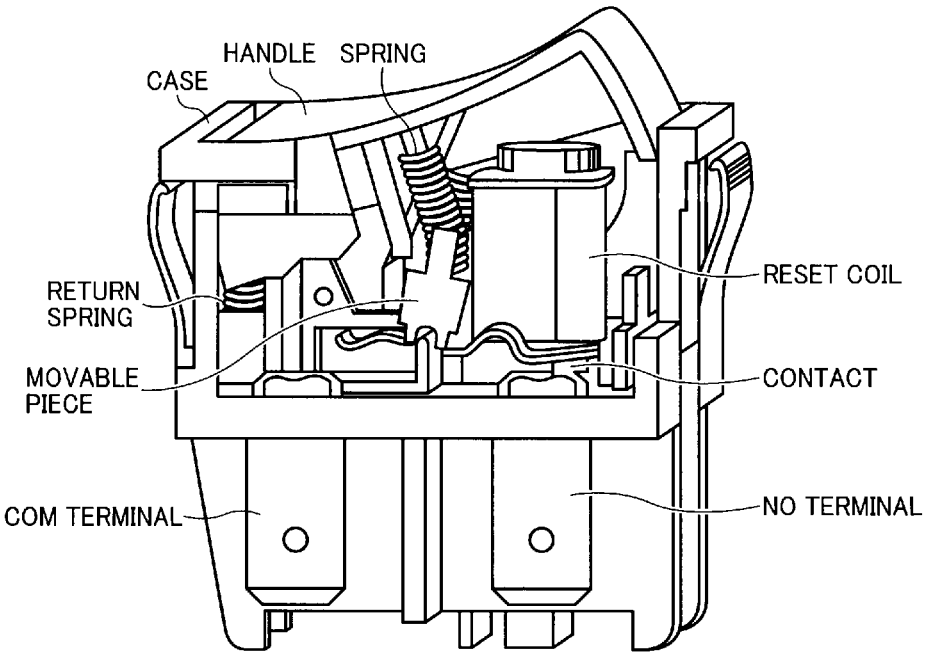
FIG. 19 is a view showing the internal structure and the appearance of a reset switch (RS3 series) manufactured by Hirose Electric Co., Ltd.

Meanwhile, each of FIGS. 1, 2, and 9 shows part of the switch body 10 shown in FIG. 1, and is a view illustrating the feature of the invention for easy understanding. A means for realizing the invention can also be realized by modifying, altering, or changing the structure of an existing switch. For example, it is easy for those skilled in the art to embody the invention by modifying, altering, or changing the internal structure of a switch such as a reset switch (RS3 series manufactured by Hirose Electric Co., Ltd.) shown in FIG. 19.

Third Embodiment

Next, a third embodiment will be described. The mechanical structure of a switch body 10 of a switch device according to a third embodiment is the same as that of the switch body of the switch device according to the first embodiment shown in FIG. 1. Accordingly, the mechanical structure of the switch body of the switch device according to the third embodiment is not shown in the drawings.

The structure of a mechanism, which changes the state of a first electrical contact point to an open state (a contact point OFF state) from a closed state (a contact point ON state) in the switch device according to the third embodiment, will be described with reference to FIG. 2 that has been used to describe the first embodiment. FIG. 2 shows a state where current does not flow in the electromagnet (switch contact point lever On-to-OFF operation electromagnet coil 4*b*) yet when the first electrical contact point is in an ON state (closed state). Since the structure of each part shown in FIG. 2 is the same as that of the first embodiment, the description thereof will not be repeated.

Further, an operation and a mechanism, which changes the state of the first electrical contact point to an OFF state by making current flow in the switch contact point lever ON-to-OFF operation electromagnet coil 4*b* when the switch manipulation portion 1 is positioned at an OFF position, are the same as those of the first embodiment.

Meanwhile, when the switch manipulation portion 1 is positioned at an ON position, the first and second electrical contact points are maintained in a closed state (ON state). In this case, if current (which may be direct current or may be alternate current) flows in the switch contact point lever ON-to-OFF operation electromagnet coil 4*b*, the right portions of the first switch contact levers 21 and 22 in FIG. 2 are pulled down and the left upper portions of the first switch contact levers 21 and 22 in FIG. 2 come into contact with the left lower portion of the switch manipulation portion 1 (The switch manipulation portion 1 is not shown in FIG. 2. A positional relationship between the switch manipulation portion 1 and the first switch contact levers 21 and 22 is shown in FIG. 1). Accordingly, the switch manipulation portion 1 is pushed up from below. As a result, the switch manipulation portion 1 comes to be positioned at an OFF position by being interlocked with an operation that the state of the first electrical contact point (that is, the first switch contact lever-side contact point 21*c* and the first switch terminal-side contact point 21*d*, and the first switch contact lever-side contact point (not shown) and the first switch terminal-side contact point (not shown) corresponding to the first switch contact lever 22) is changed to an open state. Meanwhile, since the lower portion 1*b* of the switch manipulation portion 1 comes into contact with the entire surface of the second switch contact lever 3 that is positioned on the inner side, the switch manipulation portion 1 is manipulated to an OFF position from an ON position and the second switch contact lever 3 pivots. Therefore, the contact state between the second switch contact lever-side contact point (not shown) and the second switch terminal-side contact point (not shown), which correspond to the second switch contact lever 3, is canceled, so that the state of the second electrical contact point becomes an open state (a contact point OFF state).

Meanwhile, if a set value of excitation current or an electromagnetic force of the switch contact point lever ON-to-OFF operation electromagnet coil 4*b* is appropriately changed, it may be possible to prevent the state of the first electrical contact point from being forcibly changed to an OFF state when the switch manipulation portion 1 is positioned at an ON position. In other words, it may be possible to provide a switch where the state of the first electrical contact point can be changed to an OFF state only when the switch manipulation portion 1 is positioned at an OFF position.

Even when the state of the switch manipulation portion 1 is an ON state, the state of the first electrical contact point can be changed by signals output from units provided outside the switch device so that the manipulation state of the switch manipulation portion 1 and the state of the first electrical contact point are changed into an OFF state. As the case where the above-mentioned forcible switch OFF is available, there are a case where it is determined that there is no user around, a case where a switch is automatically and daily or weekly turned off in a mode like an operation by a timer, a case where it is detected that ambient brightness is equal to or lower than a predetermined brightness level, a case where it is detected that an ambient sound volume is equal to or lower than a predetermined sound volume, a case where it is detected that various other environments are changed, a case where it is recognized that a system is not operated or does not operate for a predetermined time period or more, a case where it is recognized that the frequency of the operation of a system is equal to or smaller than a predetermined value, and the like.

For example, the following method is considered as a specific determining method. An external unit is provided with a luminance sensor that detects the ambient brightness around a switch device system. A switch device is provided with the luminance sensor so that the state of the first electrical contact point is changed to an OFF state from an ON state and the states of the switch manipulation portion 1 and the second electrical contact point are changed to an OFF state from an ON state if a state where the ambient brightness around the switch device system is equal to or lower than a predetermined brightness continues for a predetermined time period or more when a switch manipulation portion 1 has been continued to be positioned at an ON position.

An external unit is provided with a sound volume detecting unit that detects the ambient sound volume around a switch device system. A switch device is provided with the sound volume detecting unit so that the state of the first electrical contact point is changed to an OFF state from an ON state and the states of the switch manipulation portion 1 and the second electrical contact point are changed to an OFF state from an ON state, if a state where the ambient sound volume around the switch device system is equal to or lower than a predetermined volume level continues for a predetermined time period or more when a switch manipulation portion 1 is positioned at an ON position.

An external unit is provided with a human sensor that detects the presence of a human body around a switch device system. A switch device is provided with the human sensor so that the state of the first electrical contact point is changed to an OFF state from an ON state and the states of the switch manipulation portion 1 and the second electrical contact point are changed to an OFF state from an ON state, if a state where the presence of a human body around the switch device system is not detected continues for a predetermined time period or more when a switch manipulation portion 1 is positioned at an ON position.

An external unit is provided with a present time acquiring unit that acquires the present time. A switch device is configured in a manner such that the state of the first electrical contact point is changed to an OFF state from an ON state and the states of the switch manipulation portion 1 and the second electrical contact point are changed to an OFF state from an ON state, if the present time acquired by the present time acquiring unit is a predetermined time when a switch manipulation portion 1 is positioned at an ON position.

An external unit is provided with a present date and time acquiring unit that acquires the present date and time and the present day of the week. A switch device is configured in a manner such that the state of the first electrical contact point is changed to an OFF state from an ON state and the states of the switch manipulation portion 1 and the second electrical contact point are changed to an OFF state from an ON state, if the present date and time and the present day of the week acquired by the present date and time acquiring unit are date and time and day of the week corresponding to predetermined conditions when a switch manipulation portion 1 is positioned at an ON position.

Meanwhile, the predetermined time, the present day of the week, or the date and time corresponding to predetermined conditions may be programmably and arbitrarily set.

An external unit is provided with a recognition unit that recognizes the time where a switch apparatus including a switch device or a switch device system is not operated or the time where the switch device system is not operated. The switch device is configured in a manner such that the state of the first electrical contact point is changed to an OFF state from an ON state and the states of the switch manipulation portion 1 and the second electrical contact point are changed to an OFF state from an ON state, if the time where the switch apparatus including the switch device or the switch device system is not operated or the time where the switch device system is not operated, which is recognized by the recognition unit, is equal to or longer than a predetermined time, when a switch manipulation portion 1 is positioned at an ON position.

An external unit is provided with an operation detecting unit that detects the operation of a switch apparatus including a switch device or a switch device system or the motion of the switch apparatus; and a determining unit that determines the frequency of the operation of the switch apparatus or the motion of the switch apparatus within a predetermined time. The switch device is configured in a manner such that the state of the first electrical contact point is changed to an OFF state from an ON state and the states of the switch manipulation portion 1 and the second electrical contact point are changed to an OFF state from an ON state, if a frequency determined by the determining unit is equal to or lower than a predetermined frequency, when a switch manipulation portion 1 is positioned at an ON position.

Figure 20:
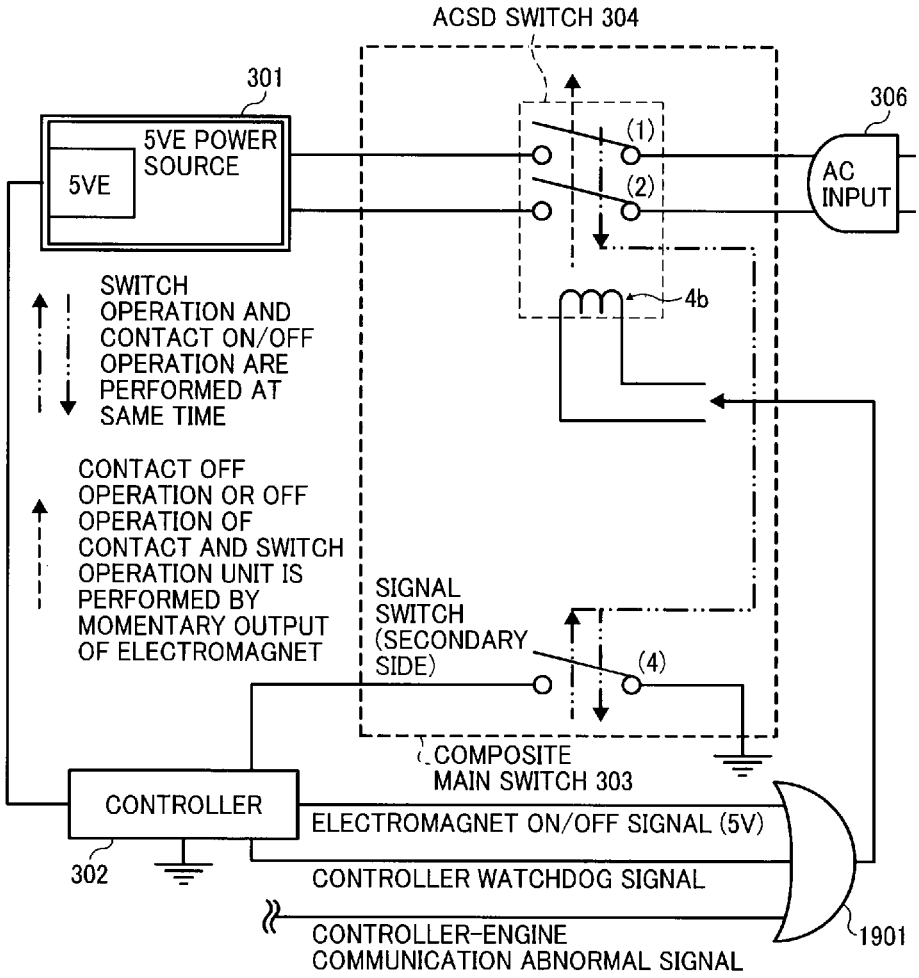
FIG. 20 is a circuit diagram illustrating the flow of a signal and the operation of a contact point of a switch according to a third embodiment.

Next, there will be described a circuit structure that makes the state of the first electrical contact point be in an open state by making current flow in the electromagnet. FIG. 20 is a circuit diagram illustrating the flow of a signal and the operation of a contact point of the switch of the third embodiment.

As shown in FIG. 20, a circuit structure of this embodiment mainly includes a 5VE power source 301, a controller 302, a composite main switch 303, and an OR circuit 1901. Here, the structures and functions of the 5VE power source 301 and the composite main switch 303 are the same as those of the first embodiment.

The 5VE power source 301 is a power source for the control of a DC low-voltage and is a power source that is required to always supply an output voltage of DC 5V or the like when a control unit is operating. The composite main switch 303 includes an ACSD switch 304 and a signal switch (4).

As in the first embodiment, the ACSD switch 304 includes switch circuits (1) and (2). Further, the ACSD switch 304 includes an electromagnet that makes the states of switch contacts of the switch circuits (1) and (2) become an OFF state or makes the state of the switch manipulation portion 1 become an OFF state. Meanwhile, only a switch contact point lever ON-to-OFF operation electromagnet coil **4*b* of the electromagnet is shown in FIG. 20**.

As in the first embodiment, the signal switch (4) corresponds to a second switch contact lever-side contact point and a second switch terminal-side contact point (which are not shown) as a second electrical contact point. The state of the signal switch (4) becomes a closed state (a contact point ON state) by an interlocking operation with an ON manipulation of the switch manipulation portion 1 and becomes an open state (a contact point OFF state) by an interlocking operation with an OFF manipulation of the switch manipulation portion 1. The controller 302 can detect which position of an ON position and an OFF position the switch manipulation portion 1 is manipulated to, by detecting the ON/OFF state of the signal switch (4).

When the switch manipulation portion 1 is manipulated to an ON position, the states of the switch circuits (1) and (2) become an ON state, that is, a closed state. Accordingly, AC power is supplied to the 5VE power source 301 from a commercial power source AC input 306. Meanwhile, when the switch manipulation portion 1 is manipulated to an OFF position, the states of the contact points of the switch circuits (1) and (2) as the first electrical contact point do not immediately become an open state due to the above-mentioned mechanism in order to prevent the sudden interruption of AC power.

Further, if the controller 302 determines that AC power needs to be interrupted even when the controller 302 detects the closed state of the switch contact point of the signal switch (4), current is output from the controller 302 to the switch contact point lever ON-to-OFF operation electromagnet coil 4*b* of the electromagnet and the electromagnet is turned on after necessary shutdown pre-processing is performed. Further, the contact points of the switch circuits (1) and (2) are opened, and the states of the switch manipulation portion 1 and the second electrical contact point are also changed to an OFF state from an ON state.

In FIG. 20, as in the first embodiment, an arrow shown by a two-dot chain line shows an ON/OFF state where an electrical contact point operates interlocking with the manipulation of the switch manipulation portion 1. Accordingly, the switch circuits (1) and (2) enter a closed state (a contact point ON state) by an interlocking operation with only the ON manipulation of the switch manipulation portion 1 in an open state (a contact point OFF state). (The switch circuits (1) and (2), which have entered a closed state (a contact point ON state) once, maintain a closed state (a contact point ON state) when the ON/OFF manipulation of the switch manipulation portion 1 is performed later.) It may be possible to make the states of the switch circuits (1) and (2) become an open state (a contact point OFF state) by making current flow in the switch contact point lever ON-to-OFF operation electromagnet coil 4*b* (to be described below).

An arrow shown by a dotted line of FIG. 20 shows that the state of the switch contact point may be changed to an OFF state from an ON state by a momentary force of the electromagnet. Such contact points correspond to contact points of the switch circuits (1) and (2). That is, when current flows in the switch contact point lever ON-to-OFF operation electromagnet coil 4*b*, the states of the switch circuits (1) and (2) are changed to an open state from a closed state.

Further, when the switch manipulation portion 1 is positioned at an OFF position (when the state of the second electrical contact point is an OFF state), the state of only the first electrical contact point becomes a contact point OFF state. However, when the switch manipulation portion 1 is positioned at an ON position, not only the state of the first electrical contact point becomes a contact point OFF state but also the states of the switch manipulation portion 1 and the second electrical contact point are also changed to an OFF state from an ON state.

The controller 302 is connected to the 5VE power source 301, and the controller 302 detects the open/closed state of the signal switch (4). In this embodiment, if the controller 302 determines that the AC power needs to be interrupted even when the controller 302 detects the open state of the signal switch (4) or recognizes that the switch manipulation portion 1 is positioned at an ON position, the controller immediately performs shutdown pre-processing as in the first embodiment.

When the controller 302 completely performs the shutdown pre-processing, the controller 302 outputs an electromagnet ON signal to the electromagnet and turns the electromagnet on by making current flow in the switch contact point lever ON-to-OFF operation electromagnet coil 4*b* of the electromagnet. Accordingly, the states of the contact points of the switch circuits (1) and (2) serving as the first electrical contact point become an open state and a contact point OFF state.

Furthermore, in this embodiment, as the countermeasure for overdrive (or, overload) of the controller 302, there is provided a countermeasure that obtains a logical sum of a watchdog signal (WD signal), a communication abnormal signal, and an electromagnet ON/OFF signal by an OR circuit 1901 and cuts off AC power by turning the electromagnet on even when a controller the WD signal or a communication abnormal signal is generated.

Figure 21:
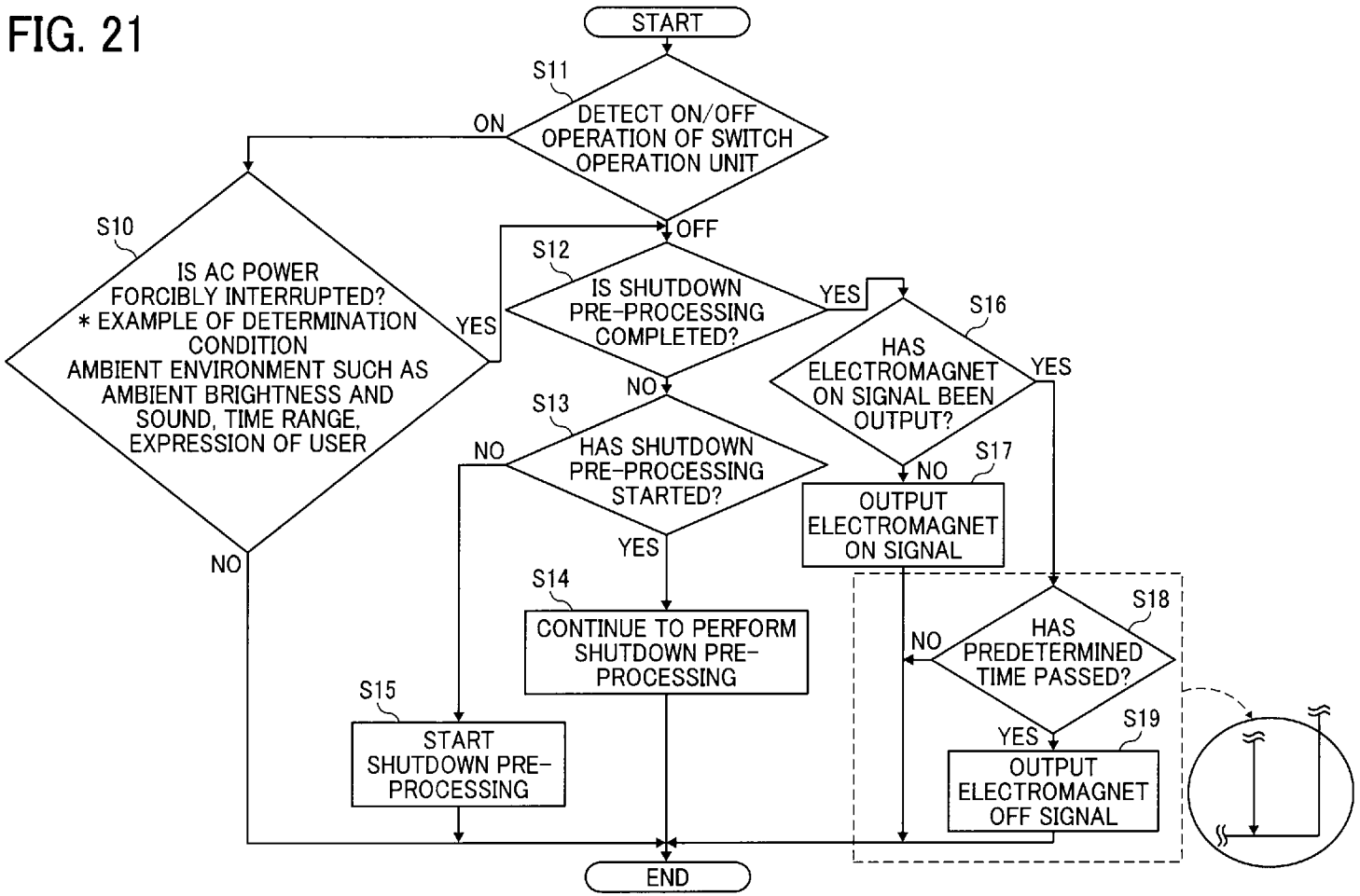
FIG. 21 is a flowchart illustrating a procedure of control processing that is performed by a controller of the third embodiment.

Next, the control of changing the state of the first electrical contact point to a contact point OFF state (open state) from a contact point ON state (closed state), which is performed by the controller 302, will be described in detail. FIG. 21 is a flowchart illustrating a procedure of control processing that is performed by the controller 302 of the third embodiment. Here, the control processing shown in FIG. 21 may be adapted to be performed every time during the main routine of the control performed by the controller, and may be adapted to be performed every predetermined time such as every 20 msec.

First, the controller 302 detects which position of an ON position and an OFF position the switch manipulation portion 1 is positioned at, by detecting the open/closed state of the second electrical contact point, that is, the signal switch (4) (Step S11).

Further, processing, which are to be performed when the switch manipulation portion 1 is positioned at an OFF position (OFF at Step S11, Steps S12 to S19), is performed in the same manner as those of the first embodiment.

Meanwhile, if the switch manipulation portion 1 is positioned at an ON position in Step S11 (ON at Step S11), the controller 302 determines whether to forcibly interrupt AC power (Step S10). The determination conditions will be shown below.

That is, examples of the determination conditions include a case where it is determined that there is no user around by a switch device system including a switch device, a case where it is determined a time range where a switch device system including a switch device is not used by the daily or weekly management like a timer, a case where it is detected that ambient environments such as ambient brightness or sound are changed, and the like.

Further, if it is determined that AC power is forcibly interrupted (Yes at Step S10), the procedure proceeds to Step S12 and the processing of Steps S12 to S19 are performed. Meanwhile, if it is determined that AC power is not interrupted in Step S10 (No at Step S10), the controller stands by until the next processing.

Meanwhile, even in this embodiment, the processing of Steps S18 and S19 may not be performed and a rectangular area represented by a dotted line may be changed to a circular area represented by a solid line in the flowchart of FIG. 21.

In this embodiment as described above, the same advantages as those of the first embodiment are obtained, and it may be possible to change the operation state of the switch and the state of the switch contact point to an OFF state by a signal sent from a unit provided outside the switch device when the operation state of the switch and the state of the switch contact point are an ON state, like switches with a reset function as in the related art (for example, AJ8R series manufactured by Panasonic Electric Works Co., Ltd., RS3 series manufactured by Hirose Electric Co., Ltd., A8G series manufactured by Omron Corporation, and the like).

Modification of Third Embodiment

In the third embodiment, the power of the electromagnet has been supplied from the controller. However, the invention is not limited thereto. As in the first modification of the first embodiment, power of the electromagnet is generated from AC lines in this modification.

Figure 22:
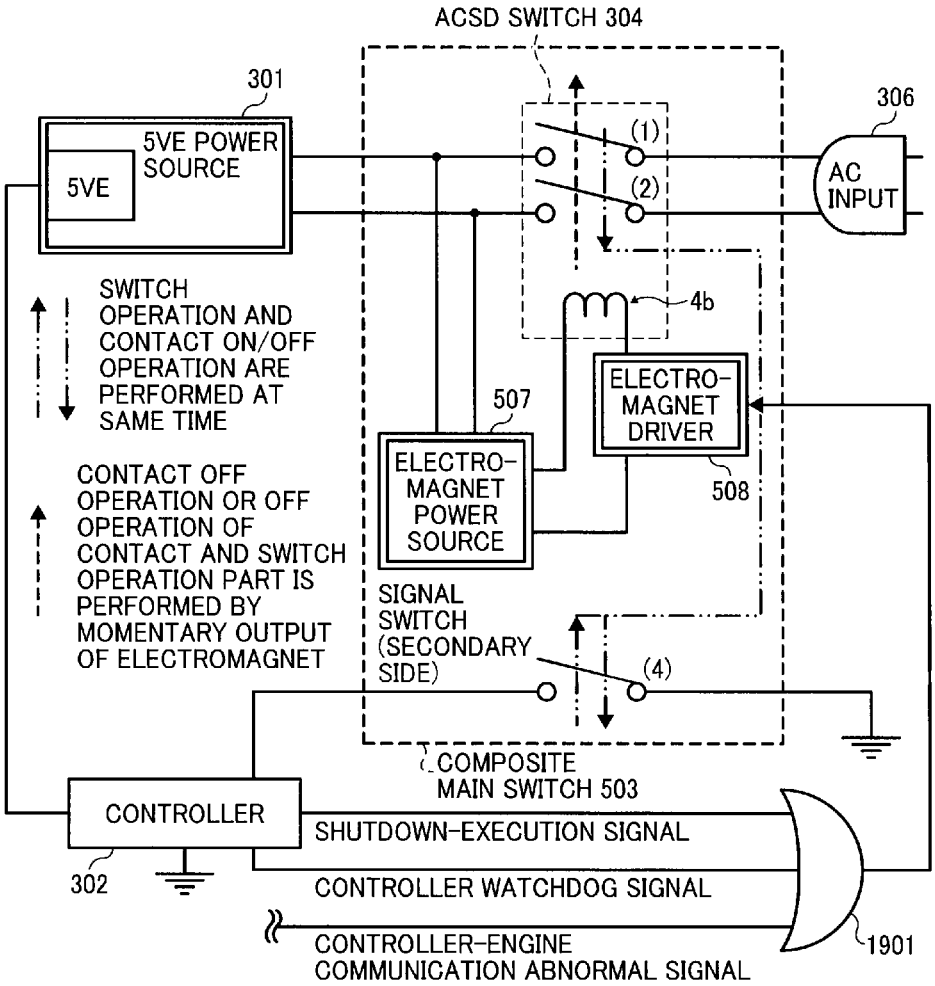
FIG. 22 is a circuit diagram illustrating the flow of a signal and the operation of a contact point of a switch according to a modification of the third embodiment.

FIG. 22 is a circuit diagram illustrating the flow of a signal and the operation of a contact point of a switch of the modification of the third embodiment. The structure of a switch body 10 and the structure, which changes the state of the first electrical contact point to a contact point OFF state from a contact point ON state, of this modification are the same as those of FIGS. 1 and 2 that have been described in the first and third embodiments.

As shown in FIG. 22, a circuit structure of this modification mainly includes a 5VE power source 301, a controller 302, a composite main switch 503, and an OR circuit 1901. Here, the structures and functions of the 5VE power source 301, the controller 302, and the OR circuit 1901 are the same as those of the third embodiment. For this reason, the description of the same portions as those of FIG. 20 that has been described in the third embodiment, or the description of portions similar to those of FIG. 20 will not be repeated.

The composite main switch 503 of this modification includes an ACSD switch 304, a signal switch (4), an electromagnet power source 507, and an electromagnet driver 508. The ACSD switch 304 includes switch circuits (1) and (2), and an electromagnet (switch contact point lever ON-to-OFF operation electromagnet coil 4*b*) that makes the state of the first electrical contact point become a contact point OFF state when the state of the first electrical contact point is a contact point ON state. Here, the function and structure of the ACSD switch 304 are the same as those of the third embodiment.

The electromagnet power source 507 is a power source for an electromagnet (switch contact point lever ON-to-OFF operation electromagnet coil 4*b*) that is used to open the switch contact points of the switch circuits (1) and (2) or to change the states of the switch manipulation portion 1 and the second electrical contact point to an OFF state from an ON state. As shown in FIG. 22, the electromagnet power source 507 obtains power from AC lines that are positioned behind an AC input 306, which is a commercial power source, with the switch circuits (1) and (2) interposed therebetween, and generates power that is suitable to turn the electromagnet on. Here, power to be generated may be DC power or AC power, or the power of the AC lines may be directly transmitted in some cases.

The electromagnet driver 508 turns the electromagnet on and off by a control signal sent from the controller 302. Since the electromagnet driver 508 is provided in this modification, there is no problem even if the control signal output from the controller 302 has low energy (low current).

The electromagnet driver 508 receives a control signal output from the controller 302 and can make the electromagnet power source 507 supply or interrupt power to the electromagnet (supply or interrupt current to the electromagnet). The electromagnet driver 508 may be formed of a relay circuit or a semiconductor switching element, or may be formed of a circuit including a triac and the like in the case of AC power.

Meanwhile, the control processing, which is performed by the controller 302 of this embodiment, is the same as that of the third embodiment that has been described with reference to FIG. 21.

Since the electromagnet power source 507 is provided inside the composite main switch 503 in this modification, the controller 302 does not need to be provided with a power source for turning the electromagnet on. Accordingly, it may be possible to obtain an advantage of increasing the degree of freedom in the design of the controller 302.

Fourth Embodiment

In the third embodiment, the state of the first electrical contact point is changed to a contact point OFF state from a contact point ON state by the electromagnet. However, in this embodiment, the state of the first electrical contact point is changed to a contact point OFF state from a contact point ON state by a bimetal as in the second embodiment.

In this embodiment, the structure of a switch body 10 is the same as that of FIG. 1 that has been described in the first and third embodiments. The structure of a mechanism, which changes the state of the first electrical contact point to an open state (a contact point OFF state) from a closed state (a contact point ON state), of this embodiment is different from those of the first and third embodiments.

The structure of a mechanism, which changes the state of the first electrical contact point to a contact point OFF state by a bimetal when the state of the first electrical contact point is a closed state (a contact point ON state) in a switch device according to the fourth embodiment will be described with reference to FIG. 9 that is described in the second embodiment.

When the switch manipulation portion 1 is manipulated to an OFF position from an ON position, the state of a second electrical contact point (a second switch contact lever-side contact point and a second switch terminal-side contact point) becomes an open state as described in the first embodiment. However, the first electrical contact point (a first switch contact lever-side contact point 21*c* and a first switch terminal-side contact point 21*d*, and a first switch contact lever-side contact point (not shown) and a first switch terminal-side contact point (not shown) corresponding to the first switch contact lever 22) maintains a contact state, and the state of the first electrical contact point remains a closed state (a contact point ON state).

In this embodiment, current is made to flow in the bimetal heating heater wire 4*e* by a circuit structure to be described below. Accordingly, as in the second embodiment, the contact state (closed state) of the first electrical contact point (that is, the first switch contact lever-side contact point 21*c* and the first switch terminal-side contact point 21*d*, and the first switch contact lever-side contact point (not shown) and the first switch terminal-side contact point (not shown) corresponding to the first switch contact lever 22) is canceled, and is changed to an open state (a contact point OFF state). Here, current, which flows in the bimetal heating heater wire 4*e*, may be any one of direct current and alternate current.

Meanwhile, FIG. 9 shows a state where current flows in the bimetal heating heater wire 4*e* and the right portions of the first switch contact levers 21 and 22 are pushed down, so that the state of the first electrical contact point is changed to a contact point OFF state from a contact point ON state.

Furthermore, in this embodiment, as in the third embodiment, the state of the first electrical contact point becomes a contact point OFF state when the switch manipulation portion 1 is positioned at an OFF position (when the state of the second electrical contact point is an OFF state), and the state of the first electrical contact point becomes a contact point OFF state and the states of the switch manipulation portion 1 and the second electrical contact point are changed to an OFF state from an ON state when the switch manipulation portion 1 is positioned at an ON position.

Figure 23:
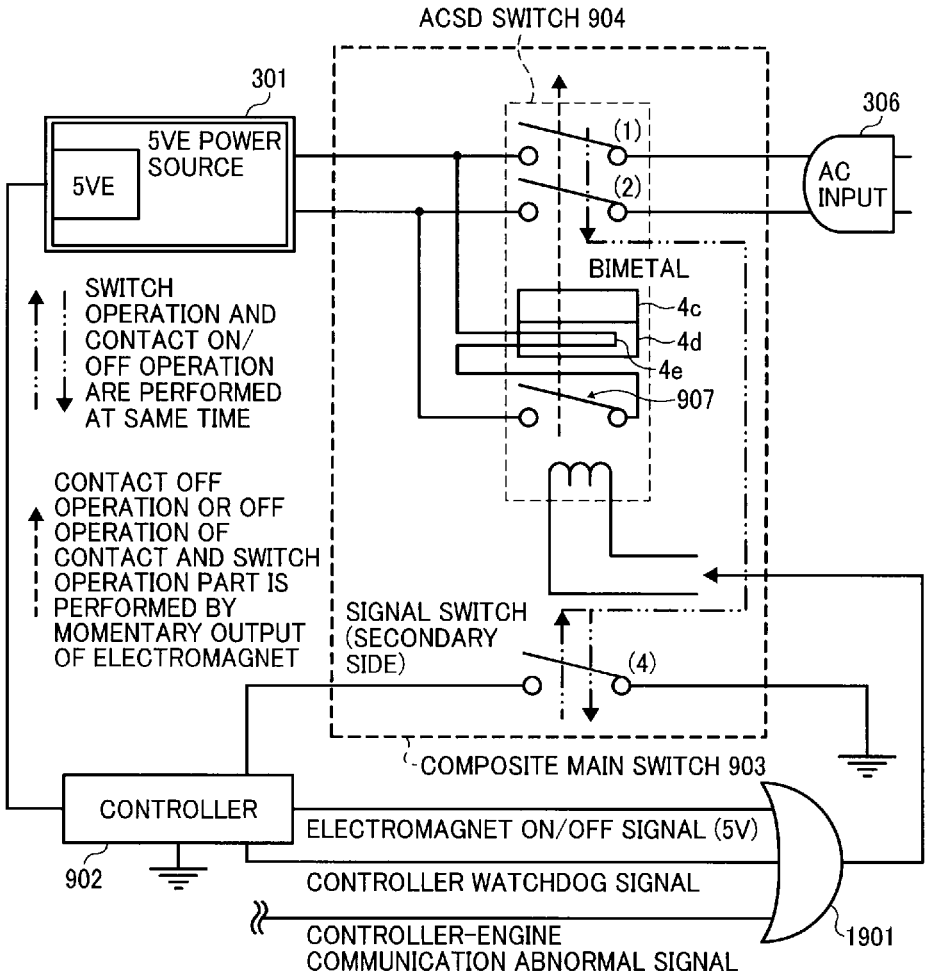
FIG. 23 is a circuit diagram illustrating the flow of a signal and the operation of a contact point of a switch according to a fourth embodiment.

Next, there will be described a circuit structure that makes the state of the first electrical contact point become an open state by making current flow in the bimetal heating heater wire 4*e*. FIG. 23 is a circuit diagram illustrating the flow of a signal and the operation of a contact point of the switch of the fourth embodiment.

As shown in FIG. 23, a circuit structure of this embodiment mainly includes a 5VE power source 301, a controller 902, a composite main switch 903, and an OR circuit 1901. Here, the structures and functions of the 5VE power source 301 and the OR circuit 1901 are the same as those of the third embodiment.

The composite main switch 903 of this embodiment includes an ACSD switch 904 that includes switch circuits (1) and (2), bimetal 4*c* and 4*d*, and a relay 907; and a signal switch (4). Here, the functions and structures of the switch circuits (1) and (2) and the signal switch (4) are the same as those of the third embodiment.

Power of the bimetal heating heater wire 4*e* is obtained from AC lines that are positioned behind a commercial power source AC input 306 with the switch circuits (1) and (2) interposed therebetween. When the relay 907 is turned on and current flows in the bimetal heating heater wire 4*e*, the switch circuits (1) and (2), which are the first electrical contact point, can be opened or the position of the switch manipulation portion 1 can be changed to an OFF position due to the deformation of the bimetal 4*c* and 4*d*.

When the controller 902 completely performs shutdown pre-processing, the controller outputs a relay ON signal, which is current for turning the relay 907 on, thereby to turn the relay 907 on. Accordingly, current flows in the bimetal heating heater wire 4*e*, so that the states of the switch circuits (1) and (2) become an open state and a contact point OFF state due to the thermal deformation of the bimetal 4*c* and 4*d*. In this case, if the switch manipulation portion 1 is positioned at an ON position, the contact points of the switch circuits (1) and (2) are opened and the states of the switch manipulation portion 1 and the second electrical contact point are changed to an OFF state from an ON state.

Figure 24:
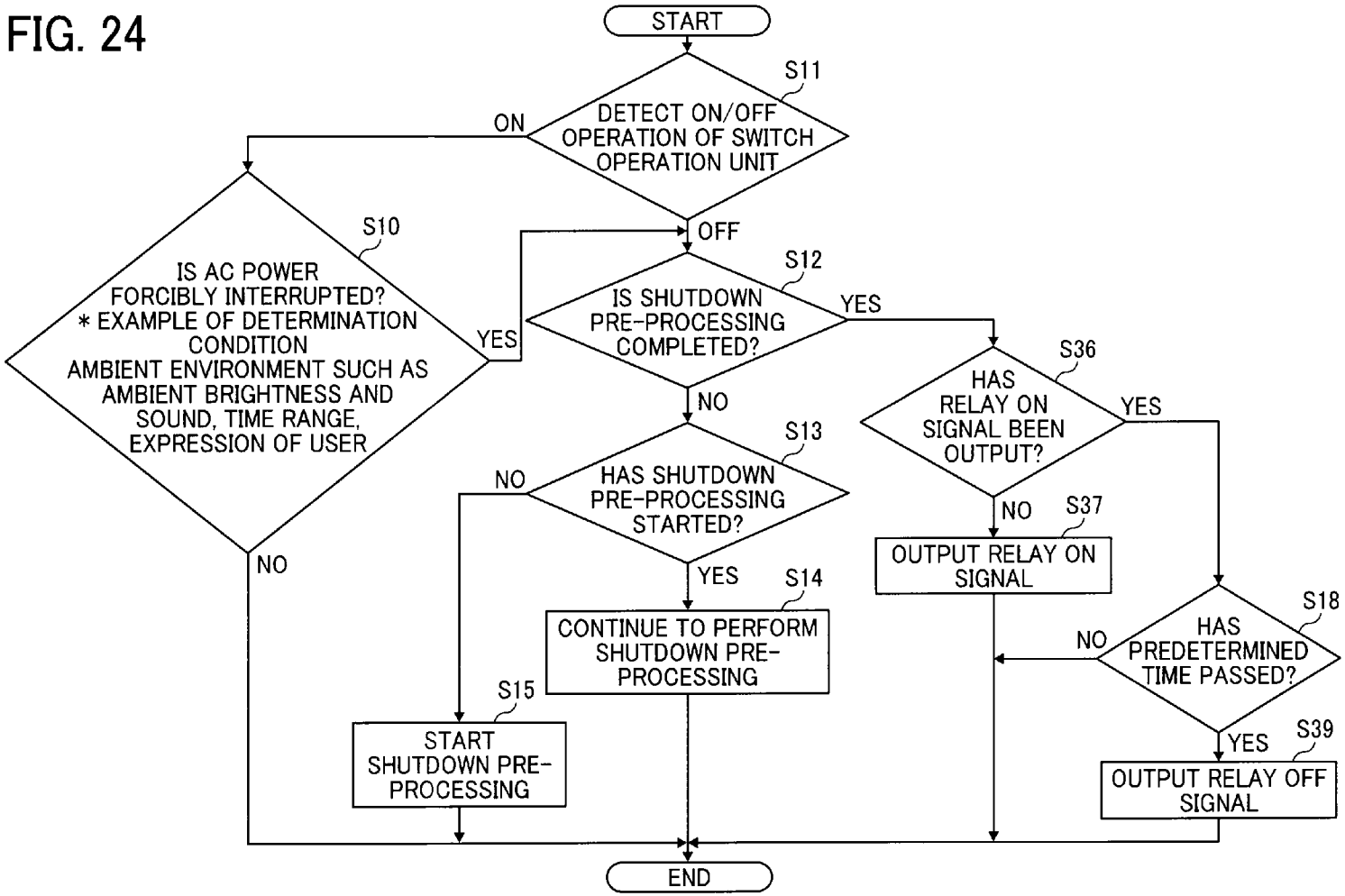
FIG. 24 is a flowchart illustrating a procedure of control processing that is performed by a controller of the fourth embodiment.

Next, there will be described the control of chafing the state of the first electrical contact point to a contact point OFF state (open state) from a contact point ON state (closed state) that is performed by the controller 902. FIG. 24 is a flowchart illustrating a procedure of control processing that is performed by the controller 902 of the fourth embodiment.

First, the controller 902 detects which position of an ON position and an OFF position the switch manipulation portion 1 is positioned at, by detecting the open/closed state of the second electrical contact point, that is, the signal switch (4) (Step S11).

Further, processing, which are to be performed when the switch manipulation portion 1 is positioned at an OFF position (OFF at Step S11, Steps S12 to S15, S18, S36, S37, and S39), are performed in the same manner as those of the second embodiment.

Meanwhile, if the switch manipulation portion 1 is positioned at an ON position in Step S11 (ON at Step S11), the controller 902 determines whether to forcibly interrupt AC power (Step S10). As in the third embodiment, examples of the determination conditions include a case where it is determined that there is no user around by a switch device system including a switch device, a case where it is determined a time range where a switch device system including a switch device is not used by the daily or weekly management by a timer, a case where it is detected that ambient environments such as ambient brightness or sound are changed, and the like.

Further, if it is determined that AC power is forcibly interrupted (Yes at Step S10), the procedure proceeds to Step S12 and the processing of Steps S12 to S15, S18, S36, S37, and S39 is performed. Meanwhile, if it is determined that AC power is not interrupted in Step S10 (No at Step S10), the controller stands by until the next processing.

In this embodiment as described above, the same advantages as those of the second embodiment are obtained, and it may be possible to change the operation state of the switch and the state of the switch contact point to an OFF state by a signal sent from a unit provided outside the switch device when the operation state of the switch and the state of the switch contact point are an ON state, like switches with a reset function as in the related art (for example, AJ8R series manufactured by Panasonic Electric Works Co., Ltd.; RS3 series manufactured by Hirose Electric Co., Ltd.; A8G series manufactured by Omron Corporation; and the like).

Embodiments and modifications have been described above, but the invention is not limited thereto.

Meanwhile, the sizes, directions, or positional relationships of the respective components shown in FIG. 1, 2, or 9 may also be modified in various ways. Further, the drawings of the invention are to illustrate the nature of the invention, and the detailed portions of the switch outside the scope of the invention are not shown and not described. For example, it goes without saying that a switch requires a structure where a spring is provided between the lower portion of the switch manipulation portion 1 and the switch contact lever 21, 22, or 23 in order to reliably maintain the contact states of the switch contact points.

Further, in the above-mentioned embodiments, ON/OFF of the commercial power source AC input 306 has been exemplified as the first electrical contact point. However, the first electrical contact point is not limited thereto. For example, the switch device according to each of the above-mentioned first to fourth embodiments and the switch device system, which includes the switch device and an external unit, may be applied to transport equipment or automobiles of battery mounted apparatuses, image forming apparatuses, electrical equipment, machine tools, medical equipment, and the like. Furthermore, a spatial distance or a creeping distance, which is required in terms of safety and function, needs to be secured due to the difference in service voltage or AC/DC in the switch.

According to the invention, it may be possible to obtain advantages of being capable of safely stopping an apparatus even though a power switch is suddenly turned off; interrupting AC power by the power switch when an apparatus is not used; incurring less unnecessary power consumption during the operation of an apparatus; incurring less unnecessary power consumption in an OFF mode of the apparatus; reducing space, which is required for a switch or necessary parts, as much as possible; and manufacturing a switch device at lower cost.

(Note 1) A switch device comprising:

a switch manipulation portion that is manipulated between an ON position and an OFF position;

a detecting unit that detects which position the switch manipulation portion is positioned at, the ON position or the OFF position;

a first mechanism that, when the switch manipulation portion is manipulated from the OFF position to the ON position, causes a first electrical contact point including one or more circuits to enter an ON state; and a second mechanism that, when the switch manipulation portion is manipulated from the ON position to the OFF position, causes the switch manipulation portion to enter an OFF state and to maintain the ON state of the first electrical contact point including one or more circuits, and changes the state of the first electrical contact point to the OFF state from the ON state by making an electrical signal be in an OFF state, an ON state, and an OFF state in this order.

(Note 2) A switch device comprising:

a switch manipulation portion that is manipulated between an ON position and an OFF position;

a detecting unit that detects which position the switch manipulation portion is positioned at, the ON position or the OFF position;

a first mechanism that, when the switch manipulation portion is manipulated from the OFF position to the ON position, causes a first electrical contact point including one or more circuits to enter an ON state;

a second mechanism that, when the switch manipulation portion is manipulated from the ON position to the OFF position, causes the switch manipulation portion to enter an OFF state, and to maintain the ON state of the first electrical contact point including one or more circuits, and changes the state of the first electrical contact point to the OFF state from the ON state by making an electrical signal, which is input to the switch device, be in an OFF state, an ON state, and an OFF state in this order; and a third mechanism that, when the switch manipulation portion is positioned at the ON position and the first electrical contact is in the ON state, changes the position of the switch manipulation portion from the ON position to the OFF position and changes the state of the first electrical contact point from the ON state to the OFF state by the electrical signal, which is input to the switch device, that is in an OFF state, an ON state, and an OFF state in this order.

(Note 3) The switch device according to note 1 or 2, wherein the second mechanism changes the state of the first electrical contact point including one or more circuits from the ON state to the OFF state by supplying electromagnetic energy for a short time, and the third mechanism changes the position of the switch manipulation portion from the ON position to the OFF position by supplying electromagnetic energy for a short time.

(Note 4) The switch device according to note 1 or 2, further comprising:

a bimetal that is formed by bonding two metal materials having different coefficients of thermal expansion, wherein the second mechanism changes the state of the first electrical contact point including one or more circuits from the ON state to the OFF state by making current flow in the bimetal, in which the first electrical contact point maintains its OFF state even though the current flowing in the bimetal is interrupted after the state of the first electrical contact point is changed to the OFF state by the current flowing in the bimetal, and the third mechanism changes the position of the switch manipulation portion from the ON position to the OFF position by supplying current flow in the bimetal.

(Note 5) The switch device according to note 1 or 2, wherein the detecting unit includes a light shielding plate and a photointerrupter, the light shielding plate being interlocked with the switch manipulation portion in terms of operation.

(Note 6) The switch device according to note 1 or 2, wherein the detecting unit, whenever the switch manipulation portion is manipulated from the OFF position to the ON position and from the ON position to the OFF position, detects that the state of a second electrical contact point including one or more circuits is changed from the ON state to the OFF state or from the OFF state to the ON state.

(Note 7) The switch device according to note 5, wherein the second mechanism changes the state of the first electrical contact point including one or more circuits from the ON state to the OFF state by supplying electromagnetic energy for a short time, or the third mechanism changes the position of the switch manipulation portion from the ON position to the OFF position by supplying electromagnetic energy for a short time.

(Note 8) The switch device according to note 5, wherein the second mechanism changes the state of the first electrical contact point including one or more circuits from the ON state to the OFF state by making current flow in the bimetal, in which the OFF state of the first electrical contact point is maintained even though the current flowing in the bimetal is interrupted after the state of the first electrical contact point becomes the OFF state by the current flowing in the bimetal, and the third mechanism changes the position of the switch manipulation portion from the ON position to the OFF position by making current flow in the bimetal.

(Note 9) The switch device according to note 6, wherein the second mechanism changes the state of the first electrical contact point including one or more circuits from the ON state to the OFF state by supplying electromagnetic energy for a short time, and the third mechanism changes the position of the switch manipulation portion from the ON position to the OFF position by supplying electromagnetic energy for a short time.

(Note 10) The switch device according to note 6, wherein the second mechanism changes the state of the first electrical contact point including one or more circuits from the ON state to the OFF state by making current flow in the bimetal, in which the OFF state of the first electrical contact point is maintained even though the current flowing in the bimetal is interrupted after the state of the first electrical contact point becomes the OFF state by the current flowing in the bimetal, and the third mechanism changes the position of the switch manipulation portion from the ON position to the OFF position by making current flow in the bimetal.

(Note 11) The switch device according to note 1 or 2, wherein the first electrical contact point including one or more circuits outputs power that is input in an ON state but interrupts power that is input in an OFF state, the switch device further comprising:

a power generating unit that generates power, which changes the state of the first electrical contact point from the ON state to the OFF state, from power that is output when the first electrical contact point is in the ON state.

(Note 12) The switch device according to note 3, further comprising:

a power generating unit that generates power, which changes the state of the first electrical contact point from an ON state to an OFF state, from power that is output when the first electrical contact point is in an ON state, wherein the first electrical contact point including one or more circuits outputs power that is input in an ON state and interrupts power that is input in an OFF state.

(Note 13) The switch device according to note 4, further comprising:

a power generating unit that generates power, which changes the state of the first electrical contact point from an ON state to an OFF state, from power that is output when the first electrical contact point is in an ON state, wherein the first electrical contact point including one or more circuits outputs power that is input in an ON state and interrupts power that is input in an OFF state.

(Note 14) The switch device according to note 7, further comprising:

a power generating unit that generates power, which changes the state of the first electrical contact point from an ON state to an OFF state, from power that is output when the first electrical contact point is in an ON state, wherein the first electrical contact point including one or more circuits outputs power that is input in an ON state and interrupts power that is input in an OFF state.

(Note 15) The switch device according to note 8, further comprising:

a power generating unit that generates power, which changes the state of the first electrical contact point from an ON state to an OFF state, from power that is output when the first electrical contact point is in an ON state, wherein the first electrical contact point including one or more circuits outputs power that is input in an ON state and interrupts power that is input in an OFF state.

(Note 16) The switch device according to note 9, further comprising:

a power generating unit that generates power, which changes the state of the first electrical contact point from an ON state to an OFF state, from power that is output when the first electrical contact point is in an ON state, wherein the first electrical contact point including one or more circuits outputs power that is input in an ON state and interrupts power that is input in an OFF state.

(Note 17) The switch device according to note 10, further comprising:

a power generating unit that generates power, which changes the state of the first electrical contact point from an ON state to an OFF state, from power that is output when the first electrical contact point is in an ON state, wherein the first electrical contact point including one or more circuits outputs power that is input in an ON state and interrupts power that is input in an OFF state.

(Note 18) The switch device according to note 1 or 2, further comprising:

a time counter that counts time, wherein if the detecting unit detects that the position of the switch manipulation portion is changed from the ON position to the OFF position, make the time counter count, and if a predetermined time has passed, the second mechanism changes the state of the first electrical contact point from the ON state to the OFF state by making an electrical signal be in an OFF state, an ON state, and an OFF state in this order.

(Note 19) The switch device according to note 12, further comprising:

a time counter that counts time, wherein the second mechanism changes the state of the first electrical contact point from an ON state to an OFF state by making an electrical signal be in an OFF state, an ON state, and an OFF state in this order when time count performed by the time counter starts and a predetermined time has then passed if the detecting unit detects that the switch manipulation portion is manipulated from an ON position to an OFF position.

(Note 20) The switch device according to note 14, further comprising:

a time counter that counts time, wherein the second mechanism changes the state of the first electrical contact point from an ON state to an OFF state by making an electrical signal be in an OFF state, an ON state, and an OFF state in this order when time count performed by the time counter starts and a predetermined time has then passed if the detecting unit detects that the switch manipulation portion is manipulated from an ON position to an OFF position.

(Note 21) The switch device according to note 16, further comprising:

a time counter that counts time, wherein the second mechanism changes the state of the first electrical contact point from an ON state to an OFF state by making an electrical signal be in an OFF state, an ON state, and an OFF state in this order when time count performed by the time counter starts and a predetermined time has then passed if the detecting unit detects that the switch manipulation portion is manipulated from an ON state to an OFF state.

(Note 22) The switch device according to note 13, further comprising:

a current supply unit that makes current flow in the bimetal when the detecting unit detects that the position of the switch manipulation portion is changed from the ON position to the OFF position, wherein the second mechanism changes the state of the first electrical contact point from the ON state to the OFF state by deformation of the bimetal that is caused by current flowing in the bimetal, and the OFF state of the first electrical contact point is maintained even though the deformed bimetal returns to an original shape as the current flowing in the bimetal is interrupted after the state of the first electrical contact point is changed to the OFF state.

(Note 23) The switch device according to note 15, further comprising:

a current supply unit that makes current flow in the bimetal when the detecting unit detects that the position of the switch manipulation portion is changed from the ON position to the OFF position, wherein the second mechanism changes the state of the first electrical contact point from the ON state to the OFF state by deformation of the bimetal that is caused by current flowing in the bimetal, in which the OFF state of the first electrical contact point is maintained even though the deformed bimetal returns to an original shape as the current flowing in the bimetal is interrupted after the state of the first electrical contact is changed to the OFF state.

(Note 24) The switch device according to note 17, further comprising:

a current supply unit that makes current flow in the bimetal when the detecting unit detects that the position of the switch manipulation portion is changed from the ON position to the OFF position, wherein the second mechanism changes the state of the first electrical contact point from the ON state to the OFF state by deformation of the bimetal that is caused by current flowing in the bimetal, in which the OFF state of the first electrical contact point is maintained even though the deformed bimetal returns to an original shape as the current flowing in the bimetal is interrupted after the state of the first electrical contact point is changed to the OFF state.

(Note 25) A switch device system comprising:

the switch device according to note 1 or 2; and an external unit, wherein the detecting unit outputs a signal, which represents at which position the switch manipulation portion is positioned, the ON position or the OFF position, to the external unit, the external unit, to which the signal has been input, determines whether to change the state of the first electrical contact point from the ON state to the OFF state, and outputs an electrical signal to the switch device when it is determined such that it is necessary to change the state of the first electrical contact point from the ON state to the OFF state, and the switch device, to which the electrical signal has been input, changes the state of the first electrical contact point including one or more circuits from the ON state to the OFF state, or not only changes the state of the first electrical contact point from the ON state to the OFF state but also changes the position of the switch manipulation portion from the ON position to the OFF position.

(Note 26) A switch device system comprising:

the switch device according to note 3; and an external unit, wherein the detecting unit outputs a signal, which represents whether the switch manipulation portion is in an ON position or an OFF position, to the external unit, the external unit to which the signal has been input determines whether to change the state of the first electrical contact point from an ON state to an OFF state, and outputs power, which drives a coil, a relay, or the like, to the switch device when determining that the state of the first electrical contact point is to be changed from an ON state to an OFF state, and the switch device to which the power has been input performs an operation of changing the state of the first electrical contact point including one or more circuits from an ON state to an OFF state, or performs operations of changing the state of the first electrical contact point from an ON state to an OFF state and changing the position of the switch manipulation portion from an ON position to an OFF position.

(Note 27) A switch device system comprising:

the switch device according to note 4; and an external unit, wherein the detecting unit outputs a signal, which represents at which position the switch manipulation portion is positioned, the ON position or the OFF position, to the external unit, the external unit, to which the signal has been input, determines whether to change the state of the first electrical contact point from the ON state to the OFF state, and outputs an electrical signal, which makes current flow in the bimetal, to the switch device when it is determined such that it is necessary to change the state of the first electrical contact point from the ON state to the OFF state, and the switch device, to which the electrical signal has been input, changes, by an operation of the bimetal, the state of the first electrical contact point including one or more circuits from the ON state to the OFF state, or not only changes the state of the first electrical contact point from the ON state to the OFF state but also changes the position of the switch manipulation portion from the ON position to the OFF position.

(Note 28) A switch device system comprising:

the switch device according to note 5; and an external unit, wherein the detecting unit outputs a signal, which represents at which position the switch manipulation portion is positioned, the ON position or the OFF position, to the external unit, the external unit, to which the signal has been input, determines whether to change the state of the first electrical contact point from the ON state to the OFF state and outputs an electrical signal to the switch device when it is determined such that it is necessary to change the state of the first electrical contact point from the ON state to the OFF state, and the switch device, to which the electrical signal has been input, changes the state of the first electrical contact point including one or more circuits from the ON state to the OFF state, or not only changes the state of the first electrical contact point from the ON state to the OFF state but also changes the position of the switch manipulation portion from the ON position to the OFF position.

(Note 29) A switch device system comprising:

the switch device according to note 6; and an external unit, wherein the detecting unit outputs a signal, which represents at which position the switch manipulation portion is positioned, the ON position or the OFF position, to the external unit, the external unit, to which the signal has been input, determines whether to change the state of the first electrical contact point from the ON state to the OFF state, and outputs an electrical signal to the switch device when it is determined such that it is necessary to change the state of the first electrical contact point from the ON state to the OFF state, and the switch device, to which the electrical signal has been input, changes the state of the first electrical contact point including one or more circuits from the ON state to the OFF state, or not only changes the state of the first electrical contact point from the ON state to the OFF state but also changes the position of the switch manipulation portion from the ON position to the OFF position.

(Note 30) A switch device system comprising:

the switch device according to note 7; and an external unit, wherein the detecting unit outputs a signal, which represents at which position the switch manipulation portion is positioned, the ON position or the OFF position, to the external unit, the external unit, to which the signal has been input, determines whether to change the state of the first electrical contact point from the ON state to the OFF state, and outputs power, which drives a coil or a realy, to the switch device when it is determined such that it is necessary to change the state of the first electrical contact point from the ON state to the OFF state, and the switch device, to which the power has been input, changes the state of the first electrical contact point including one or more circuits from the ON state to the OFF state, or not only changes the state of the first electrical contact point from the ON state to the OFF state but also changes the position of the switch manipulation portion from the ON position to the OFF position.

(Note 31) A switch device system comprising:

the switch device according to note 8; and an external unit, wherein the detecting unit outputs a signal, which represents whether the switch manipulation portion is in an ON position or an OFF position, to the external unit, the external unit to which the signal has been input determines whether to change the state of the first electrical contact point from an ON state to an OFF state, and outputs an electrical signal, which makes current flow in the bimetal, to the switch device when determining that the state of the first electrical contact point is to be changed from an ON state to an OFF state, and the switch device to which the electrical signal has been input performs an operation of changing the state of the first electrical contact point including one or more circuits from an ON state to an OFF state, or performs operations of changing the state of the first electrical contact point from an ON state to an OFF state and changing the position of the switch manipulation portion from an ON position to an OFF position, by the operation of the bimetal.

(Note 32) A switch device system comprising:

the switch device according to note 9; and an external unit, wherein the detecting unit outputs a signal, which represents whether the switch manipulation portion is in an ON state or an OFF state, to the external unit, the external unit to which the signal has been input determines whether to change the state of the first electrical contact point from an ON state to an OFF state, and outputs power, which drives a coil, a relay, or the like, to the switch device when determining that the state of the first electrical contact point is to be changed from an ON state to an OFF state, and the switch device to which the power has been input performs an operation of changing the state of the first electrical contact point including one or more circuits from an ON state to an OFF state, or performs operations of changing the state of the first electrical contact point from an ON state to an OFF state and changing the position of the switch manipulation portion from an ON position to an OFF position.

(Note 33) A switch device system comprising:

the switch device according to note 10; and an external unit, wherein the detecting unit outputs a signal, which represents whether the switch manipulation portion is in an ON position or an OFF position, to the external unit, the external unit to which the signal has been input determines whether to change the state of the first electrical contact point from an ON state to an OFF state, and outputs an electrical signal, which makes current flow in the bimetal, to the switch device when determining that the state of the first electrical contact point is to be changed from an ON state to an OFF state, and the switch device to which the electrical signal has been input performs an operation of changing the state of the first electrical contact point including one or more circuits from an ON state to an OFF state, or performs operations of changing the state of the first electrical contact point from an ON state to an OFF state and changing the position of the switch manipulation portion from an ON position to an OFF position, by the operation of the bimetal.

(Note 34) A switch device system comprising:

the switch device according to note 11; and an external unit, wherein the detecting unit outputs a signal, which represents whether the switch manipulation portion is in an ON position or an OFF position, to the external unit, the external unit to which the signal has been input determines whether to change the state of the first electrical contact point from an ON state to an OFF state, and outputs an electrical signal as a trigger signal, to the switch device when determining that the state of the first electrical contact point is to be changed from an ON state to an OFF state, and the switch device to which the electrical signal has been input performing an operation of changing the state of the first electrical contact point including one or more circuits from an ON state to an OFF state, or performs operations of changing the state of the first electrical contact point from an ON state to an OFF state and changing the position of the switch manipulation portion from an ON position to an OFF position, by electrical energy that is generated in the switch device.

(Note 35) A switch device system comprising:

the switch device according to note 12; and an external unit, wherein the detecting unit outputs a signal, which represents whether the switch manipulation portion is in an ON state or an OFF state, to the external unit, the external unit to which the signal has been input determines whether to change the state of the first electrical contact point from an ON state to an OFF state, and outputs an electrical signal as a trigger signal, which drives a coil, a relay, or the like, to the switch device when determining that the state of the first electrical contact point is to be changed from an ON state to an OFF state, and the switch device to which the electrical signal has been input performs an operation of changing the state of the first electrical contact point including one or more circuits from an ON state to an OFF state, or performs operations of changing the state of the first electrical contact point from an ON state to an OFF state and changing the position of the switch manipulation portion from an ON position to an OFF position, by electrical energy that is generated in the switch device.

(Note 36) A switch device system comprising:

the switch device according to note 13; and an external unit, wherein the detecting unit outputs a signal, which represents whether the switch manipulation portion is in an ON state or an OFF state, to the external unit, the external unit to which the signal has been input determines whether to change the state of the first electrical contact point from an ON state to an OFF state, and outputs an electrical signal as a trigger signal, which makes current flow in the bimetal, to the switch device when determining that the state of the first electrical contact point is to be changed from an ON state to an OFF state, and the switch device to which the electrical signal has been input performs an operation of changing the state of the first electrical contact point including one or more circuits from an ON state to an OFF state, or performs operations of changing the state of the first electrical contact point from an ON state to an OFF state and changing the position of the switch manipulation portion from an ON position to an OFF position, by the operation of the bimetal caused by electrical energy that is generated in the switch device.

(Note 37) A switch device system comprising:

the switch device according to note 14; and an external unit, wherein the detecting unit outputs a signal, which represents whether the switch manipulation portion is in an ON position or an OFF position, to the external unit, the external unit to which the signal has been input determines whether to change the state of the first electrical contact point from an ON state to an OFF state, and outputs an electrical signal as a trigger signal, which drives a coil, a relay, or the like, to the switch device when determining that the state of the first electrical contact point is to be changed from an ON state to an OFF state, and the switch device to which the electrical signal has been input performs an operation of changing the state of the first electrical contact point including of one or more circuits from an ON state to an OFF state, or performs operations of changing the state of the first electrical contact point from an ON state to an OFF state and changing the position of the switch manipulation portion from an ON position to an OFF position, by electrical energy that is generated in the switch device.

(Note 38) A switch device system comprising:

the switch device according to note 15; and an external unit, wherein the detecting unit outputs a signal, which represents whether the switch manipulation portion is in an ON position or an OFF position, to the external unit, the external unit to which the signal has been input determines whether to change the state of the first electrical contact point from an ON state to an OFF state, and outputs an electrical signal as a trigger signal, which makes current flow in the bimetal, to the switch device when determining that the state of the first electrical contact point is to be changed from an ON state to an OFF state, and the switch device to which the electrical signal has been input performs an operation of changing the state of the first electrical contact point including one or more circuits from an ON state to an OFF state, or performs operations of changing the state of the first electrical contact point from an ON state to an OFF state and changing the position of the switch manipulation portion from an ON position to an OFF position, by the operation of the bimetal caused by electrical energy that is generated in the switch device.

(Note 39) A switch device system comprising:

the switch device according to note 16; and an external unit, wherein the detecting unit outputs a signal, which represents whether the switch manipulation portion is in an ON position or an OFF position, to the external unit, the external unit to which the signal has been input determines whether to change the state of the first electrical contact point from an ON state to an OFF state, and outputs an electrical signal as a trigger signal, which drives a coil, a relay, or the like, to the switch device when determining that the state of the first electrical contact point is to be changed from an ON state to an OFF state, and the switch device to which the electrical signal has been input performs an operation of changing the state of the first electrical contact point including one or more circuits from an ON state to an OFF state, or performs operations of changing the state of the first electrical contact point from an ON state to an OFF state and changing the position of the switch manipulation portion from an ON position to an OFF position, by electrical energy that is generated in the switch device.

(Note 40) A switch device system comprising:

the switch device according to note 17; and an external unit, wherein the detecting unit outputs a signal, which represents whether the switch manipulation portion is in an ON position or an OFF position, to the external unit, the external unit to which the signal has been input determines whether to change the state of the first electrical contact point from an ON state to an OFF state, and outputs an electrical signal as a trigger signal, which makes current flow in the bimetal, to the switch device when determining that the state of the first electrical contact point is to be changed from an ON state to an OFF state, and the switch device to which the electrical signal has been input performs an operation of changing the state of the first electrical contact point including one or more circuits from an ON state to an OFF state, or performs operations of changing the state of the first electrical contact point from an ON state to an OFF state and changing the position of the switch manipulation portion from an ON position to an OFF position, by the operation of the bimetal caused by electrical energy that is generated in the switch device.

(Note 41) A switch device system comprising:

the switch device according to note 18; and an external unit, wherein the switch device further includes a time counter that counts time, the detecting unit outputs a signal, which represents whether the switch manipulation portion is in an ON position or an OFF position, to the external unit, and the external unit to which the signal has been input is completely ready to interrupt power within a predetermined time, which is counted by the time counter, for the interruption of system power when it is detected that the switch manipulation portion is in an OFF position.

(Note 42) A switch device system comprising:

the switch device according to note 19; and an external unit, wherein the switch device further includes a time counter that counts time, the detecting unit outputs a signal, which represents whether the switch manipulation portion is in an ON position or an OFF position, to the external unit, and the external unit to which the signal has been input is completely ready to interrupt power within a predetermined time, which is counted by the time counter, for the interruption of system power when it is detected that the switch manipulation portion is in an OFF position.

(Note 43) A switch device system comprising:

the switch device according to note 20; and an external unit, wherein the switch device further includes a time counter that counts time, the detecting unit outputs a signal, which represents whether the switch manipulation portion is in an ON position or an OFF position, to the external unit, and the external unit to which the signal has been input is completely ready to interrupt power within a predetermined time, which is counted by the time counter, for the interruption of system power when it is detected that the switch manipulation portion is in an OFF position.

(Note 44) A switch device system comprising:

the switch device according to note 21; and an external unit, wherein the switch device further includes a time counter that counts time, the detecting unit outputs a signal, which represents whether the switch manipulation portion is in an ON position or an OFF position, to the external unit, and the external unit to which the signal has been input is completely ready to interrupt power within a predetermined time, which is counted by the time counter, for the interruption of system power when it is detected that the switch manipulation portion is in an OFF position.

(Note 45) A switch device system comprising:

the switch device according to any one of notes 22 to 24; and an external unit, wherein the detecting unit outputs a signal, which represents whether the switch manipulation portion is in an ON position or an OFF position, to the external unit, the external unit to which the signal has been input determines whether to change the state of the first electrical contact point from an ON state to an OFF state, and outputs an electrical signal as a trigger signal, which makes current flow in the bimetal, to the switch device when determining that the state of the first electrical contact point is to be changed from an ON state to an OFF state, and the switch device to which the electrical signal has been input performs an operation of changing the state of the first electrical contact point including one or more circuits from an ON state to an OFF state, or performs operations of changing the state of the first electrical contact point from an ON state to an OFF state and changing the position of the switch manipulation portion from an ON position to an OFF position, by the operation of the bimetal caused by electrical energy that is generated in the switch device.

(Note 46) The switch device system according to any one of notes 25 to 45, further comprising:

a brightness detecting unit that detects an ambient brightness of the switch device system, wherein the switch device changes the state of the first electrical contact point from an ON state to an OFF state and changes the position of the switch manipulation portion from an ON position to an OFF position if a state where the ambient brightness of the switch device system detected by the brightness detecting unit is equal to or lower than a predetermined brightness continues for a predetermined time or more when the switch manipulation portion is in an ON position.

(Note 47) The switch device system according to any one of notes 25 to 45, further comprising:

a sound volume detecting unit that detects an ambient sound volume of the switch device system, wherein the switch device changes the state of the first electrical contact point from an ON state to an OFF state and changes the position of the switch manipulation portion from an ON position to an OFF position if a state where the ambient sound volume of the switch device system detected by the volume level detecting unit is equal to or lower than a predetermined sound volume continues for a predetermined time or more when the switch manipulation portion is in an ON position.

(Note 48) The switch device system according to any one of notes 25 to 45, further comprising:

a human body detecting unit that detects the presence of a human body around the switch device system, wherein the switch device changes the state of the first electrical contact point from an ON state to an OFF state and changes the position of the switch manipulation portion from an ON position to an OFF position if a state where the presence of a human body around the switch device system is not detected by the human body detecting unit continues for a predetermined time or more when the switch manipulation portion is in an ON position.

(Note 49) The switch device system according to any one of notes 25 to 45, further comprising:

a present time acquiring unit that acquires the present time, wherein the switch device changes the state of the first electrical contact point from an ON state to an OFF state and changes the position of the switch manipulation portion from an ON position to an OFF position if the present time acquired by the present time acquiring unit is a predetermined time when the switch manipulation portion is in an ON position.

(Note 50) The switch device system according to any one of notes 25 to 45, further comprising:

a present date and time acquiring unit that acquires the present date and time, wherein the switch device changes the state of the first electrical contact point from an ON state to an OFF state and changes the position of the switch manipulation portion from an ON position to an OFF position if the present date and time and the present day of the week acquired by the present date and time acquiring unit are date and time and the present day of the week corresponding to predetermined conditions when the switch manipulation portion is in an ON position.

(Note 51) The switch device system according to note 49 or 50, wherein the predetermined time, the present day of the week, or the date and time corresponding to predetermined conditions are programmably and arbitrarily set.

(Note 52) The switch device system according to any one of notes 25 to 45, further comprising:

a recognition unit that recognizes time where a switch apparatus including the switch device or the switch device system is not operated or time where the switch apparatus does not operate, wherein the switch device changes the state of the first electrical contact point from an ON state to an OFF state and changes the position of the switch manipulation portion from an ON position to an OFF position if time where the switch device system is not operated or the switch device system does not operate, the time being recognized by the recognition unit, is equal to or longer than a predetermined time when the switch manipulation portion is in an ON position.

(Note 53) The switch device system according to any one of notes 25 to 45, further comprising:

an operation detecting unit that detects an operation of a switch apparatus including the switch device or the switch device system or a motion of the switch apparatus; and a determining unit that determines a frequency of the operation of the switch apparatus or the motion of the switch apparatus within a predetermined time, wherein the switch device changes the state of the first electrical contact point from an ON state to an OFF state and changes the position of the switch manipulation portion from an ON position to an OFF position if the frequency determined by the determining unit is equal to or higher than a predetermined frequency when the switch manipulation portion is in an ON position.

(Note 54) An image forming apparatus comprising:

the switch device according to any one of notes 1 to 24.

(Note 55) An image forming apparatus comprising:

the switch device system according to any one of notes 25 to 53.

(Note 56) An electrical equipment comprising:

the switch device according to any one of notes 1 to 24.

(Note 57) An electrical equipment comprising:
the switch device system according to any one of notes 25 to 53.
(Note 58) A medical equipment comprising:
the switch device according to any one of notes 1 to 24.
(Note 59) A medical equipment comprising:
the switch device system according to any one of notes 25 to 53.
(Note 60) A machine tool comprising:
the switch device according to any one of notes 1 to 24.
(Note 61) A machine tool comprising:
the switch device system according to any one of notes 25 to 53.
(Note 62) An automobile comprising:
the switch device according to any one of notes 1 to 24.
(Note 63) An automobile comprising:
the switch device system according to any one of notes 25 to 53.
(Note 64) A transport equipment comprising:
the switch device according to any one of notes 1 to 24.
(Note 65) A transport equipment comprising:
the switch device system according to any one of notes 25 to 53.

According to the invention, it may be possible to obtain advantages of being capable of safely stopping an apparatus even though a power switch is suddenly turned off; interrupting AC power by the power switch when an apparatus is not used; incurring less unnecessary power consumption during the operation of an apparatus; incurring less unnecessary power consumption in an OFF mode of the apparatus; reducing space, which is required for a switch or necessary parts, as much as possible; and manufacturing a switch device at lower cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A switch device comprising:
a first electrical contact point configured to include one or more circuits;
a second electrical contact point configured to include one or more circuits other than the one or more circuits included in the first electrical contact point;
a switch manipulation portion configured to cause the first electrical contact point and the second electrical contact point to enter an ON state when the switch manipulation portion is manipulated an ON position, and to cause the second electrical contact point to enter an OFF state as well as the first electrical contact point to maintain the ON state when the switch manipulation portion is manipulated an OFF position;
a detecting unit configured to detect which position the switch manipulation portion is positioned at, the ON position or the OFF position;
a first mechanism configured to cause the first electrical contact point to change the state thereof from the ON state to the OFF state, when the detecting unit detects that the switch manipulation portion is in the OFF position.

2. The switch device according to claim 1,
wherein the first mechanism changes the state of the first electrical contact point from the ON state to the OFF state by supplying electromagnetic energy for a short time, and
the switch device further comprises a second mechanism configured to change the position of the switch manipulation portion from the ON position to the OFF position by supplying electromagnetic energy for a short time.

3. The switch device according to claim 1, further comprising:
a bimetal that is formed by bonding two metal materials having different coefficients of thermal expansion,
wherein the first mechanism changes the state of the first electrical contact point including one or more circuits from the ON state to the OFF state by making current flow in the bimetal, in which the first electrical contact point maintains its OFF state even though the current flowing in the bimetal is interrupted after the state of the first electrical contact point is changed to the OFF state by the current flowing in the bimetal, and
the switch device further comprises a second mechanism configured to change the position of the switch manipulation portion from the ON position to the OFF position by supplying current flow in the bimetal.

4. A switch device system comprising:
the switch device according to claim 3; and
an external unit,
wherein the detecting unit outputs a signal, which represents at which position the switch manipulation portion is positioned, the ON position or the OFF position, to the external unit,
the external unit, to which the signal has been input,
determines whether to change the state of the first electrical contact point from the ON state to the OFF state, and
outputs an electrical signal, which makes current flow in the bimetal, to the switch device when it is determined such that it is necessary to change the state of the first electrical contact point from the ON state to the OFF state, and
the switch device, to which the electrical signal has been input,
changes, by an operation of the bimetal, the state of the first electrical contact point including one or more circuits from the ON state to the OFF state, or
not only changes the state of the first electrical contact point from the ON state to the OFF state but also changes the position of the switch manipulation portion from the ON position to the OFF position.

5. The switch device according to claim 1,
wherein the detecting unit includes a light shielding plate and a photo interrupter, the light shielding plate being interlocked with the switch manipulation portion in terms of operation.

6. The switch device according to claim 5,
wherein the first mechanism changes the state of the first electrical contact point from the ON state to the OFF state by supplying electromagnetic energy for a short time, or
the switch device further comprises a second mechanism configured to change the position of the switch manipulation portion from the ON position to the OFF position by supplying electromagnetic energy for a short time.

7. The switch device according to claim 5, wherein the first mechanism changes the state of the first electrical contact point from the ON state to the OFF state by supplying electromagnetic energy for a short time, and the switch device further comprises a second mechanism configured to change the position of the switch manipulation portion from the ON position to the OFF position by supplying electromagnetic energy for a short time.

8. The switch device according to claim 1, wherein the detecting unit, whenever the switch manipulation portion is manipulated from the OFF position to the ON position and from the ON position to the OFF position, detects that the state of the second electrical contact point is changed from the ON state to the OFF state or from the OFF state to the ON state.

9. The switch device according to claim 8, wherein the first mechanism changes the state of the first electrical contact point from the ON state to the OFF state by supplying electromagnetic energy for a short time, and the switch device further comprises a second mechanism configured to change the position of the switch manipulation portion from the ON position to the OFF position by supplying electromagnetic energy for a short time.

10. A switch device system comprising:

the switch device according to claim 1; and an external unit, wherein the detecting unit outputs a signal, which represents at which position the switch manipulation portion is positioned, the ON position or the OFF position, to the external unit, the external unit, to which the signal has been input, determines whether to change the state of the first electrical contact point from the ON state to the OFF state, and outputs an electrical signal to the switch device when it is determined such that it is necessary to change the state of the first electrical contact point from the ON state to the OFF state, and the switch device, to which the electrical signal has been input, changes the state of the first electrical contact point including one or more circuits from the ON state to the OFF state, or not only changes the state of the first electrical contact point from the ON state to the OFF state but also changes the position of the switch manipulation portion from the ON position to the OFF position.

11. The switch device according to claim 1, wherein the switch manipulation portion comprises a third mechanism configured to maintain the state of the first electrical contact point the ON state when the switch manipulation portion is manipulated from the ON position to the OFF position.

12. The switch device according to claim 1, wherein the first mechanism is activated by an electrical signal, and receives the electrical signal only when the first mechanism is to be activated.

* * * * *